US012458125B2

(12) United States Patent
Paulsmeyer

(10) Patent No.: US 12,458,125 B2
(45) **Date of Patent: *Nov. 4, 2025**

(54) ADJUSTABLE BLADE GAP CLIPPER

(71) Applicant: Doots, LLC, Lafayette, CO (US)

(72) Inventor: Todd Paulsmeyer, Lafayette, CO (US)

(73) Assignee: Doots, LLC, Lafayette, CO (US)

( * ) Notice: Subject to any disclaimer, the term of this patent is extended or adjusted under 35 U.S.C. 154(b) by 279 days.

This patent is subject to a terminal disclaimer.

(21) Appl. No.: 18/097,440

(22) Filed: Jan. 16, 2023

(65) Prior Publication Data

US 2023/0225479 A1 Jul. 20, 2023

Related U.S. Application Data

(63) Continuation of application No. 16/831,358, filed on Mar. 26, 2020, now Pat. No. 11,553,775.

(60) Provisional application No. 62/876,509, filed on Jul. 19, 2019, provisional application No. 62/828,740, filed on Apr. 3, 2019.

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC ..... A45D 29/02; A45D 2029/026
USPC ..... 30/28
See application file for complete search history.

(56) References Cited

U.S. PATENT DOCUMENTS

| | | | | |
|---|---|---|---|---|
| 797,576 | A | 8/1905 | Havell | |
| 3,180,025 | A | 4/1965 | Tsunemi | |
| 3,555,675 | A | 1/1971 | Jurena | |
| 3,744,131 | A | 7/1973 | Manes | |
| 3,832,771 | A | 9/1974 | Morgan | |
| 4,982,747 | A * | 1/1991 | Shah | A45D 29/02 30/28 |
| 5,533,262 | A | 7/1996 | Clark | |
| 5,918,375 | A | 7/1999 | Rossi, III | |
| D921,986 | S | 6/2021 | Paulsmeyer | |
| 2010/0257740 | A1 * | 10/2010 | Wu | A45D 29/02 30/28 |
| 2017/0065052 | A1 | 3/2017 | Yun | |
| 2017/0325567 | A1 | 11/2017 | Nikaran et al. | |

FOREIGN PATENT DOCUMENTS

| | | |
|---|---|---|
| CN | 2788635 | 6/2006 |
| CN | 104544900 | 4/2015 |
| EP | 1397057 | 3/2006 |

(Continued)

OTHER PUBLICATIONS

U.S. Appl. No. 62/876,509, filed Jul. 19, 2019.

(Continued)

*Primary Examiner* — Nhat Chieu Q Do
(74) *Attorney, Agent, or Firm* — Craig R. Miles; CR MILES P.C.

(57) ABSTRACT

A nail clipper including a blade gap adjustment assembly or a blade gap calibration assembly, or a combination thereof, operable to adjust a blade gap between opposed blades to allow insertion of a nail between opposed first and second blades to allow clipping of the nail while affording a barrier to insertion of the digit between the opposed blades to avoid cutting the associated digit.

10 Claims, 31 Drawing Sheets

(56) References Cited

FOREIGN PATENT DOCUMENTS

| | | | | |
|---|---|---|---|---|
| FR | 2600522 | A3 | | 12/1987 |
| JP | 3205053 | U | * | 6/2016 |
| JP | 2019068979 | A | * | 5/2019 |
| JP | 2019068979 | A1 | * | 5/2019 |
| KR | 10-2010-0120250 | A | | 11/2010 |
| WO | WO 2013/142011 | | | 9/2013 |

OTHER PUBLICATIONS

U.S. Appl. No. 62/828,740, filed Apr. 3, 2019.
PCT International Patent Application No. PCT/US20/26328, International Search Report and Written Opinion of the International Searching Authority dated Jun. 15, 2020, 12 pages.

* cited by examiner

ADJUSTABLE BLADE GAP CLIPPER

This United States Patent Application is a continuation of U.S. patent application Ser. No. 16/831,358, filed Mar. 26, 2020, now U.S. Pat. No. 11,553,775, issued on Jan. 17, 2023, which claims the benefit of U.S. Provisional Patent Application No. 62/876,509, filed Jul. 19, 2019, and U.S. Provisional Patent Application No. 62/828,740, filed Apr. 3, 2019, each hereby incorporated by reference herein.

I. FIELD OF THE INVENTION

Generally, a nail clipper for clipping nails. Specifically, a nail clipper including a blade gap adjustment assembly or a blade gap calibration assembly, or a combination thereof, operable to adjust a blade gap between opposed blades to allow insertion of a nail between opposed first and second blades to allow clipping of the nail while affording a barrier to insertion of the digit between the opposed blades to avoid cutting the associated digit.

II. A BRIEF DESCRIPTION OF THE DRAWINGS

III. DETAILED DESCRIPTION OF THE PREFERRED EMBODIMENTS

Figure 1:
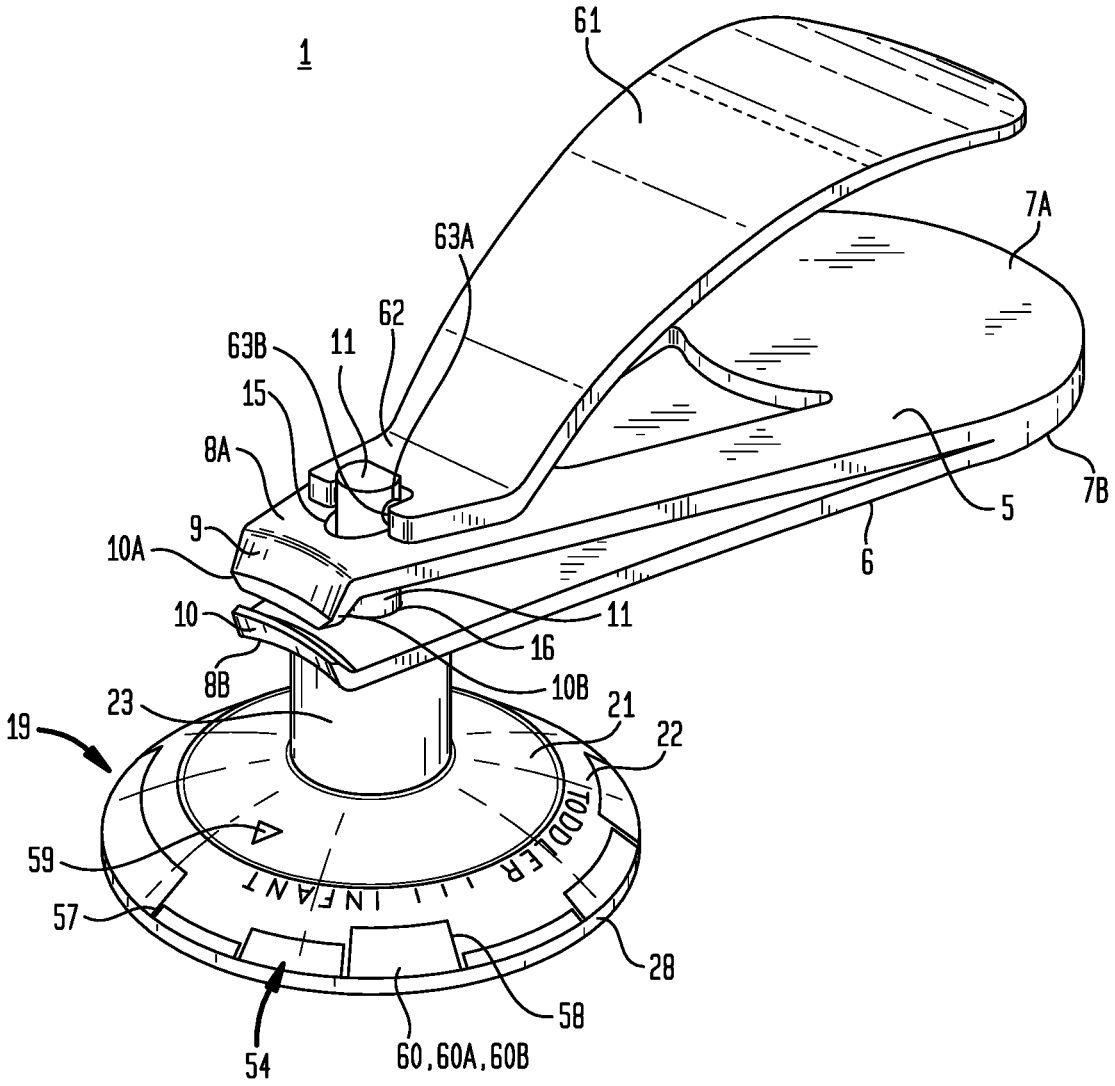
FIG. 1 is a perspective view of a particular embodiment of the inventive adjustable blade gap clipper.
Figure 2:
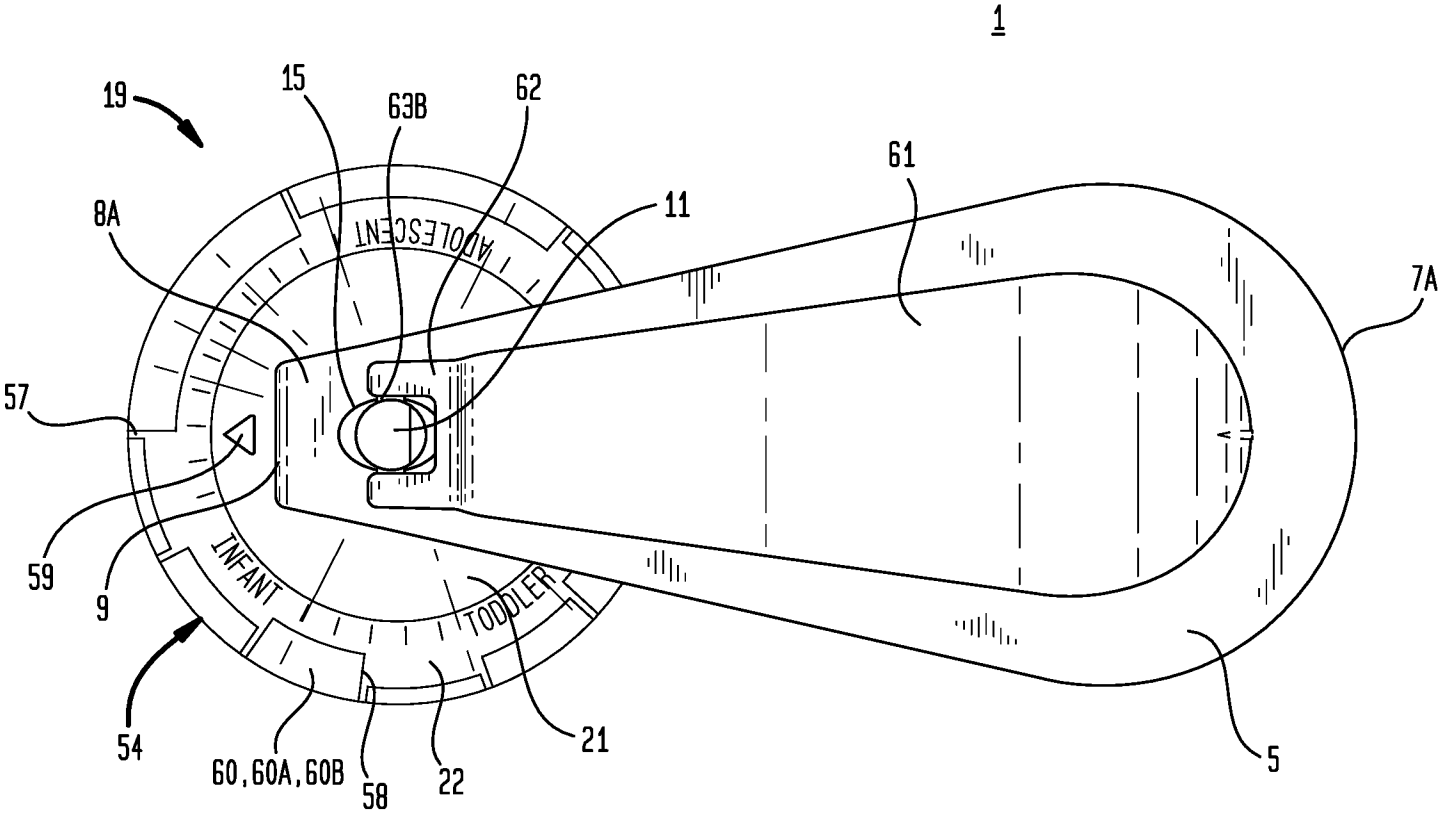
FIG. 2 is a top plan view of a particular embodiment of the inventive adjustable blade gap clipper.
Figure 3:
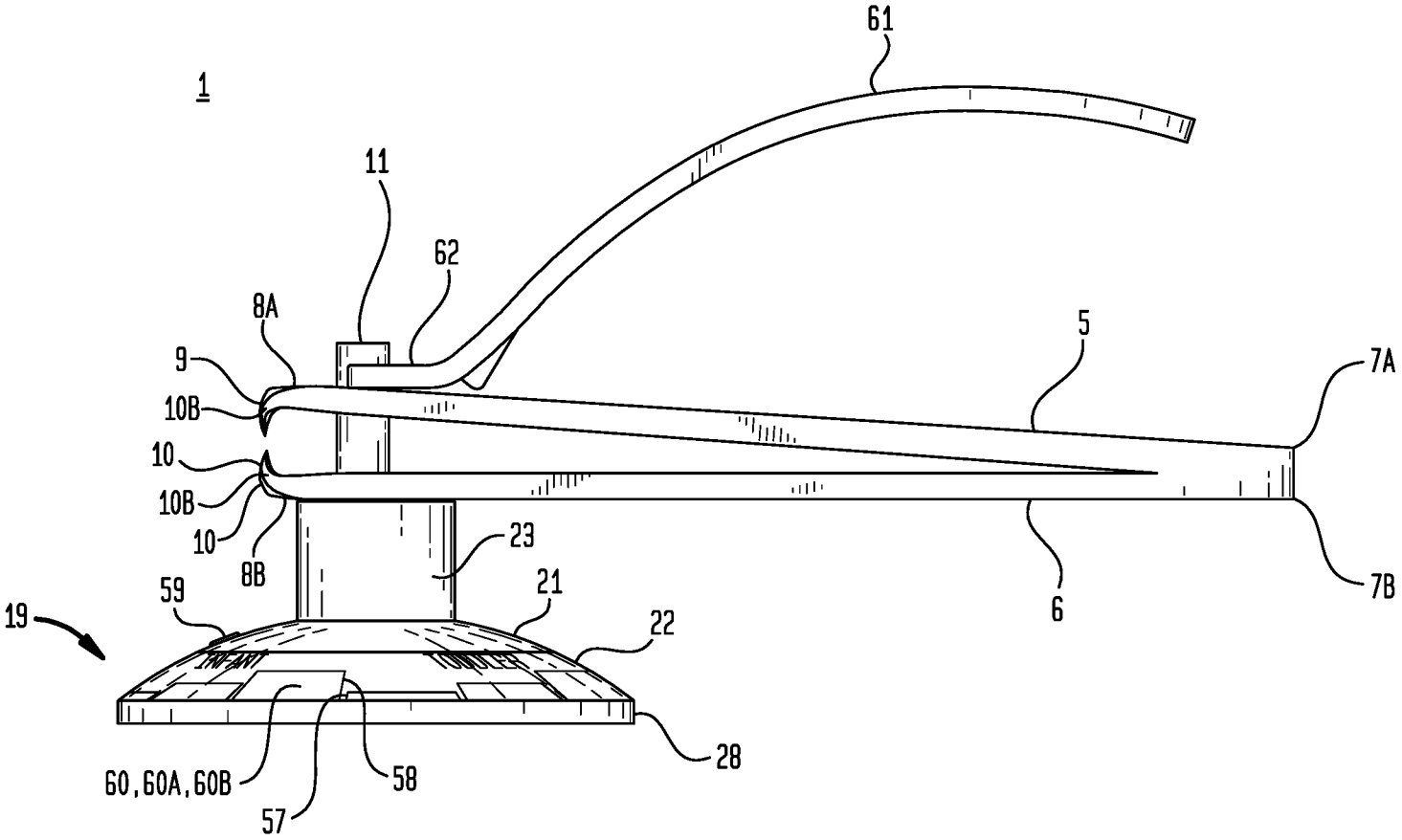
FIG. 3 is a first side elevation view of a particular embodiment of the inventive adjustable blade gap clipper.
Figure 4:
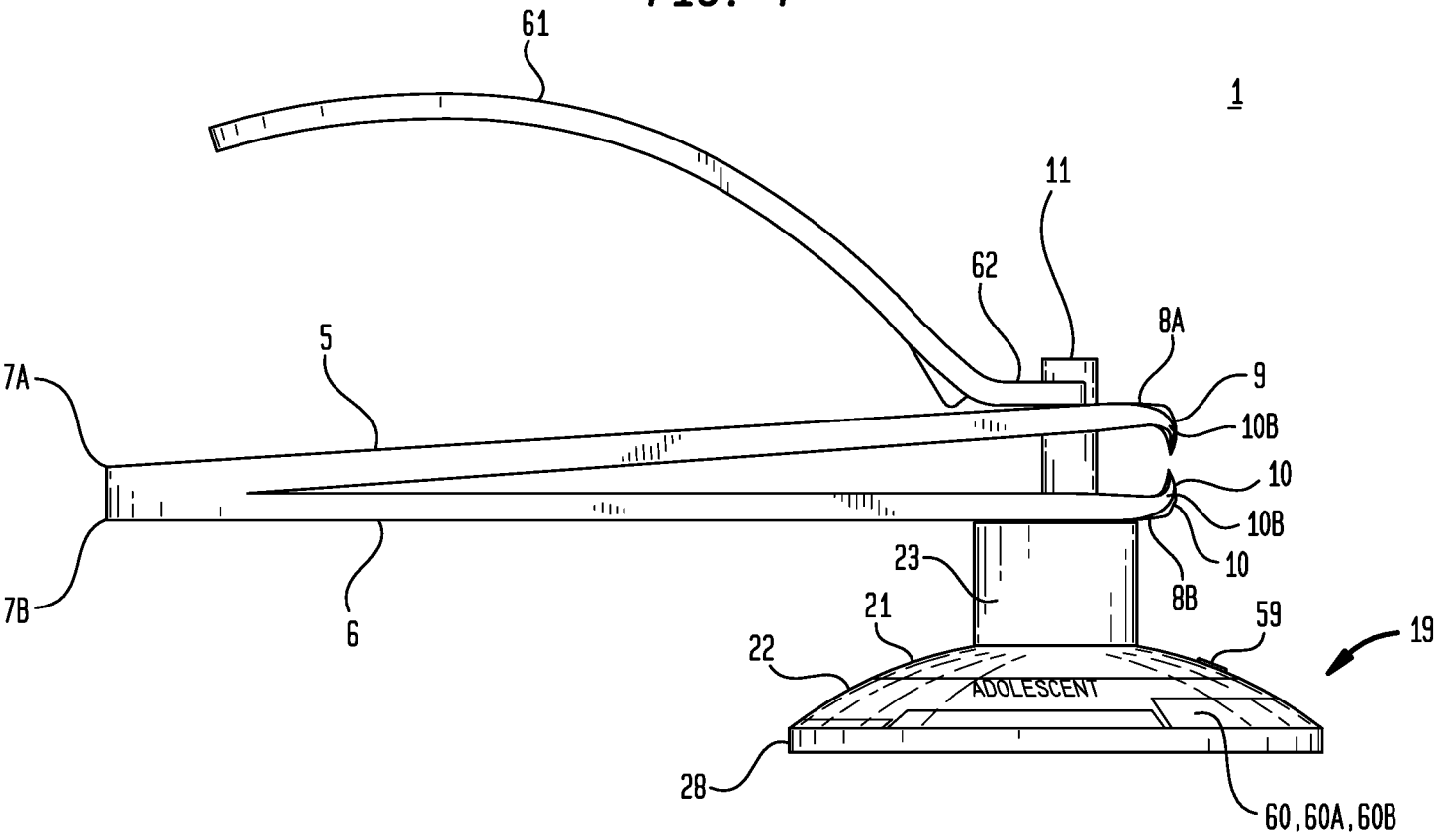
FIG. 4 is a second side elevation view of a particular embodiment of the inventive adjustable blade gap clipper.
Figure 5:
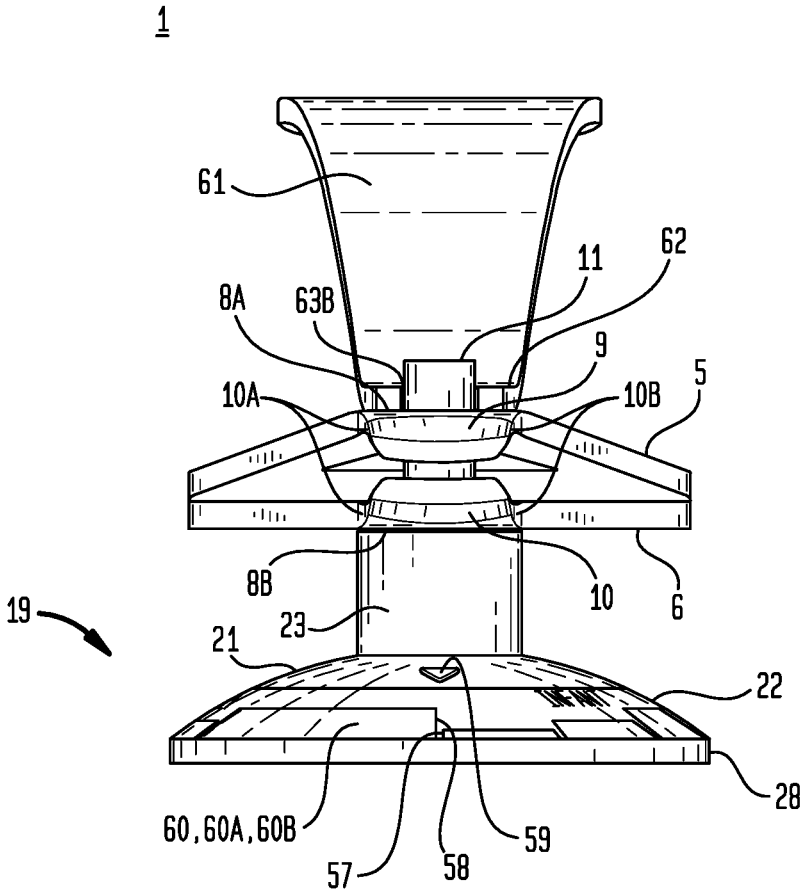
FIG. 5 is a first end elevation view of a particular embodiment of the adjustable blade gap clipper.
Figure 6:
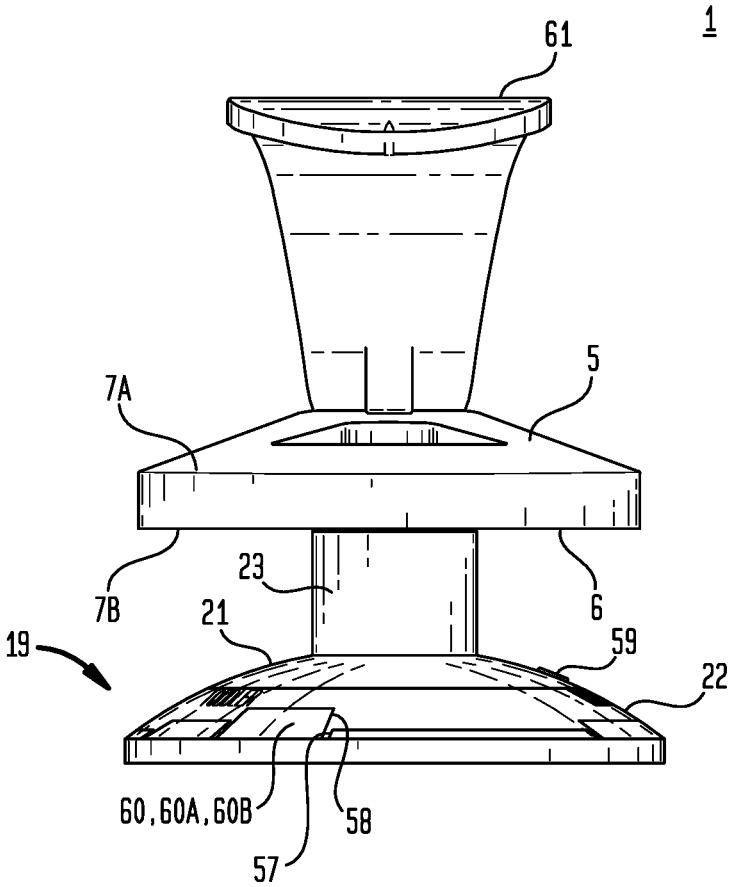
FIG. 6 is a second end elevation view of a particular embodiment of the adjustable blade gap clipper.
Figure 7:
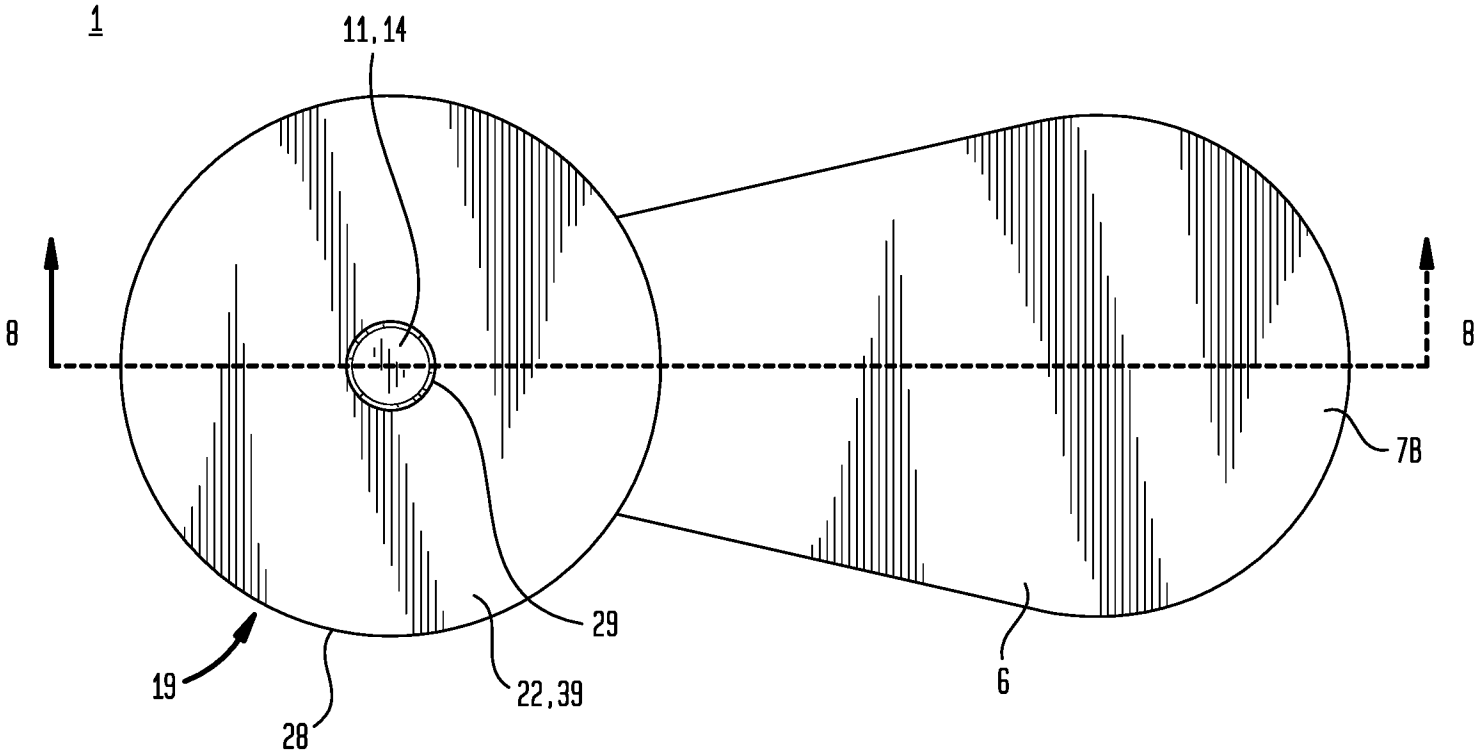
FIG. 7 is bottom plan view of a particular embodiment of the adjustable blade gap clipper.

Generally, with reference to FIGS. 1 through 31, which illustrate particular embodiments of an adjustable blade gap clipper (1) and methods of making and using embodiments of an adjustable blade gap clipper (1) to clip a nail(s) (2) extending from the digit(s) (3) of an animal (4), all of which are generically encompassed by the breadth of the inventive adjustable blade gap clipper. For the purposes of this invention the term "nail" broadly encompasses nails, claws or talons. The term "animal" broadly encompasses any animal having a nail, and without sacrificing the breadth of the foregoing, includes as illustrative examples, humans, *carnivora* (such as, dogs, cats, raccoons, hyenas, bears), kangaroos, aye-ayes, lizards, and birds. The term "digit" encompasses an anatomical member from which a nail extends and without sacrificing the breadth of the foregoing, includes the fingers or toes of land vertebrates.

Now, with general reference to FIGS. 1 through 13, particular embodiments of the adjustable blade gap clipper (1) can include a first leaf member (5) and a second leaf member (6) each including a leaf first end (7A)(7B) opposite a leaf second end (8A)(8B). The first and second leaf members (5)(6) coupled at the first leaf ends (7A)(7B) diverge outwardly approaching the leaf second ends (8A)(8B). The term "coupled" for the purposes of this invention means in the alternative, interacts directly, directly in contact (whether by mechanical fastener, adhesives, weld, or as a one-piece structure), or indirectly connected as separate structures joined, united or linked together. In particular embodiments, either the first or the second leaf member (5)(6), or both, can be resilient to allow the first or second blade (9)(10), or the first and second blades (9)(10), to move by depressing the first or second leaf member (5)(6), or by concurrently depressing both of the first and the second leaf members (5)(6). The term "resilient" for the purposes of this invention means able to recoil or spring back into shape after bending, stretching, or being compressed. The first and second leaf members (5)(6) correspondingly include a first blade (9) or a second blade (10) at the leaf second end(s) (8A)(8B). In particular embodiments, the blade first end (10A) or the blade second end (10B) (or both first and second blade ends (10A)(10B) can be hebetated to allow the first or second blade (9)(10) to be laterally slidingly engaged with a nail (2) with greater ease than conventional clippers and to avoid cutting the digit (3).

Again, with primary reference to FIGS. 1 through 13, particular embodiments can further include a post (11) having a post length (12) disposed between a post first end (13) and a post second end (14). The post (11) can pass through first and second leaf member apertures (15)(16) correspondingly disposed in the first and second leaf members (5)(6) proximate said first or second blades (9)(10). As shown in the illustrative example of FIG. 9, the post (11) can, but need not necessarily, be configured as a cylindrical member (11A) having a flat side (11B). The first or second leaf member apertures (15)(16) can correspondingly define a truncated circle (16A) allowing slidable spatial relation of the first or second leaf members (5)(6) along the post (11) between corresponding post first and second ends (13)(14) while substantially barring rotation of the first and second leaf members (15) about the post longitudinal axis (11C). In the illustrative example of FIG. 8, the first leaf member aperture (15) defines an oval aperture (15A) while the second leaf member aperture (16) defines a truncated circle (16A); however, these illustrative examples of the post (11) and leaf member aperture (15)(16) configurations are not intended to preclude other configurations of the post (11) and leaf member apertures (15)(16) in alternatives having similar function. The first and second leaf member aperture (15)(16) have sufficient dimension to accommodate the arc through which the first or second leaf member (5)(6) travels when depressed.

Again, with primary reference to FIGS. 1 through 13, particular embodiments can, but need not necessarily, include a blade gap adjustment assembly (19). The blade gap adjustment assembly (19) can move (M1) along a post first end portion (17) or a post second end portion (18) to correspondingly directly or indirectly engage the first or second leaf member (5)(6). Movement (M1) of the blade gap adjustment assembly (19) along the post first or second end portion (17)(18) correspondingly adjusts the distance between the first and second blades (9)(10) to establish a blade gap (20).

Figure 8:
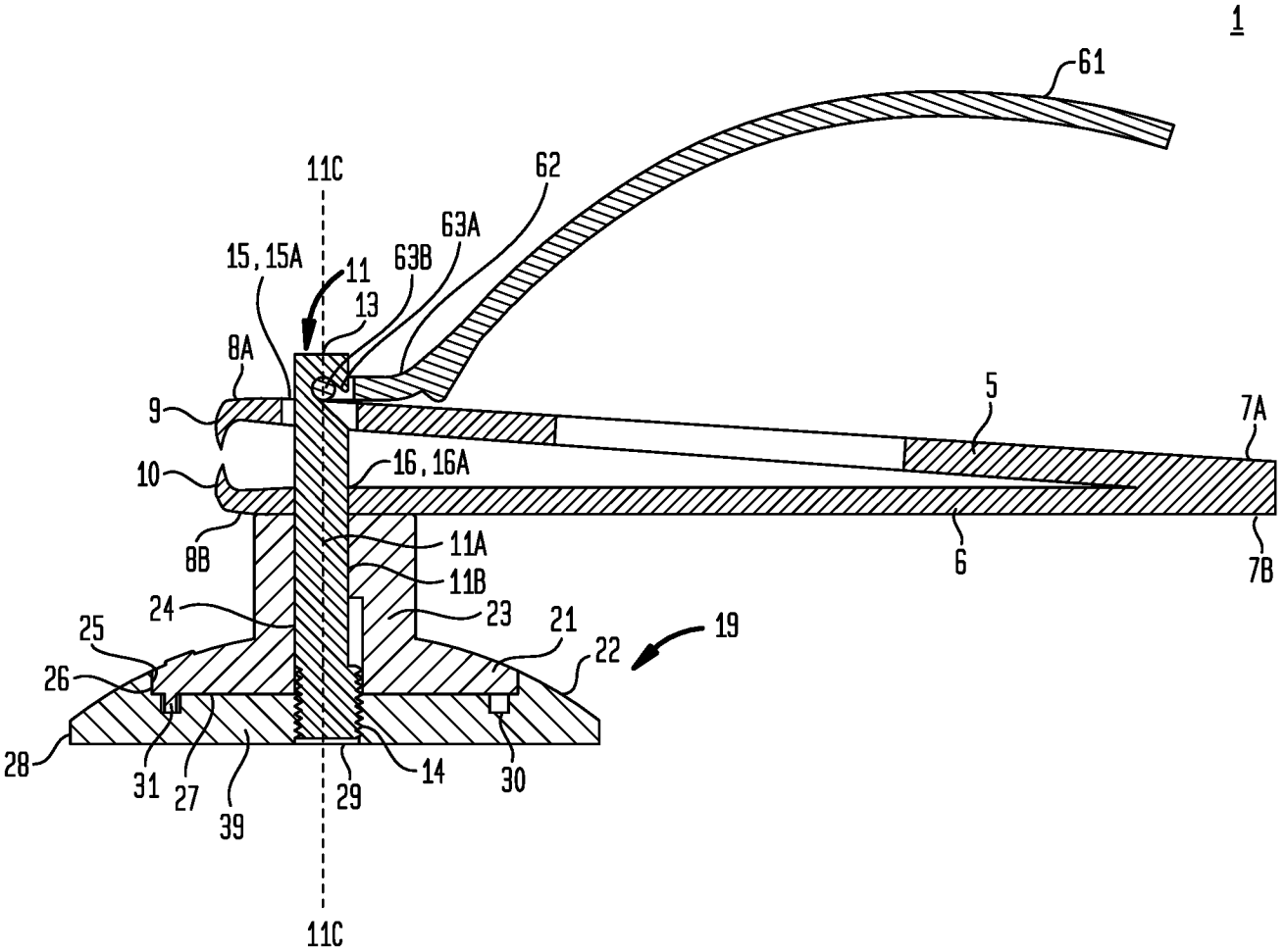
FIG. 8 is a cross section view 8-8 of the particular embodiment of the adjustable blade gap clipper shown in FIG. 7.
Figure 9:
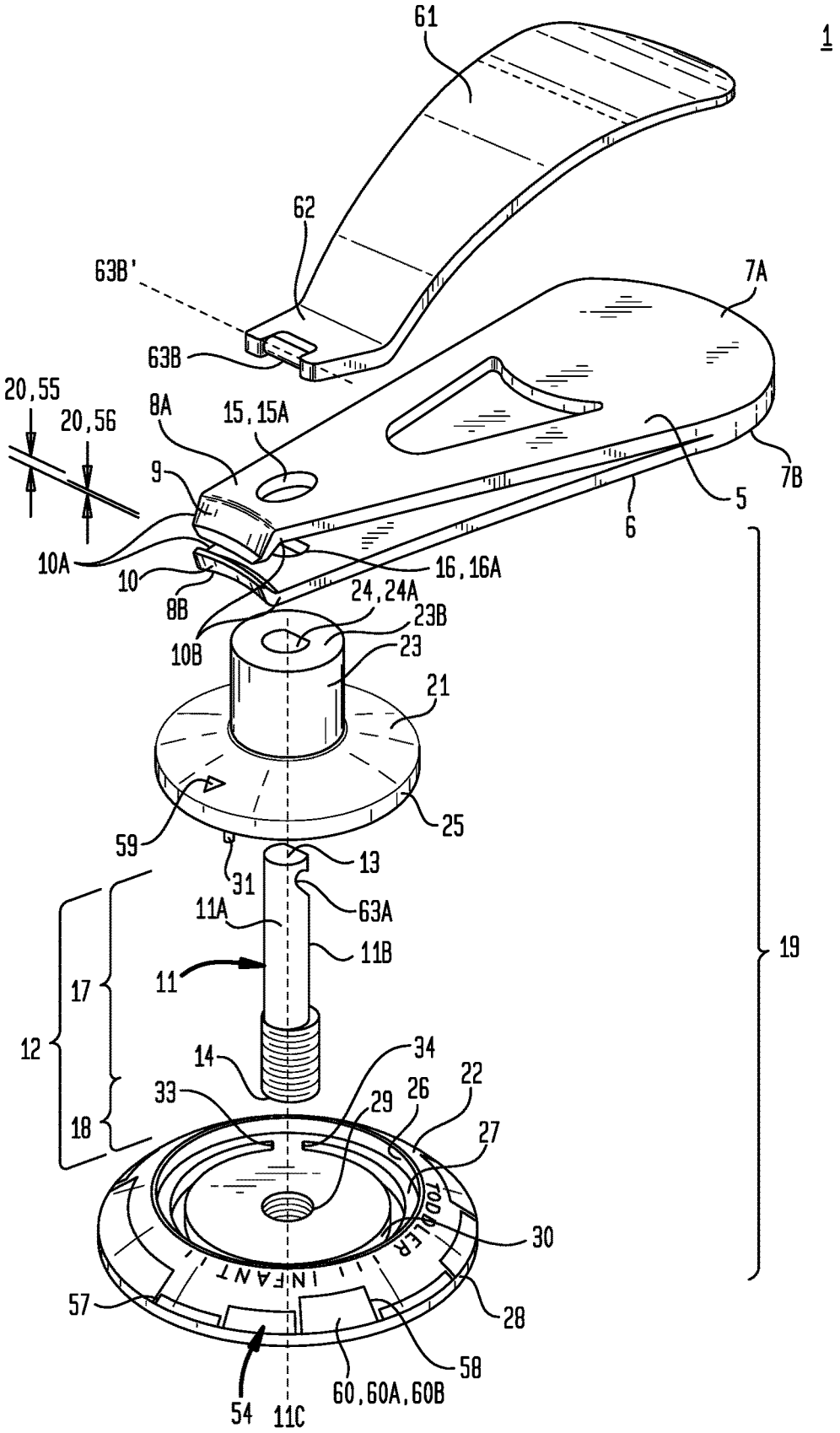
FIG. 9 is an exploded view of the particular embodiment of the adjustable blade gap clipper shown in FIGS. 1 through 8.
Figure 10:
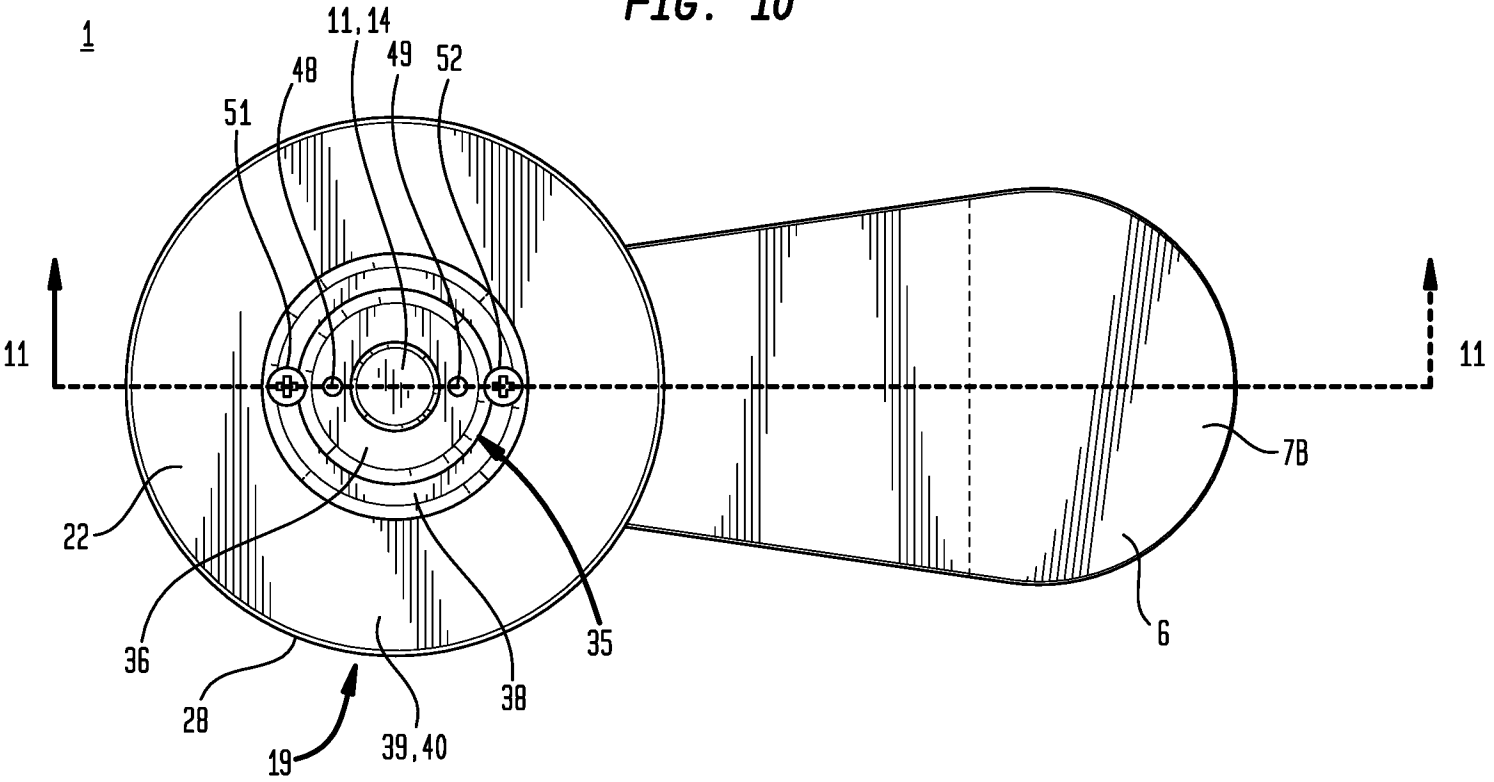
FIG. 10 is a bottom plan view of a particular embodiment of the adjustable blade gap clipper further including a blade gap calibration member.
Figure 11:
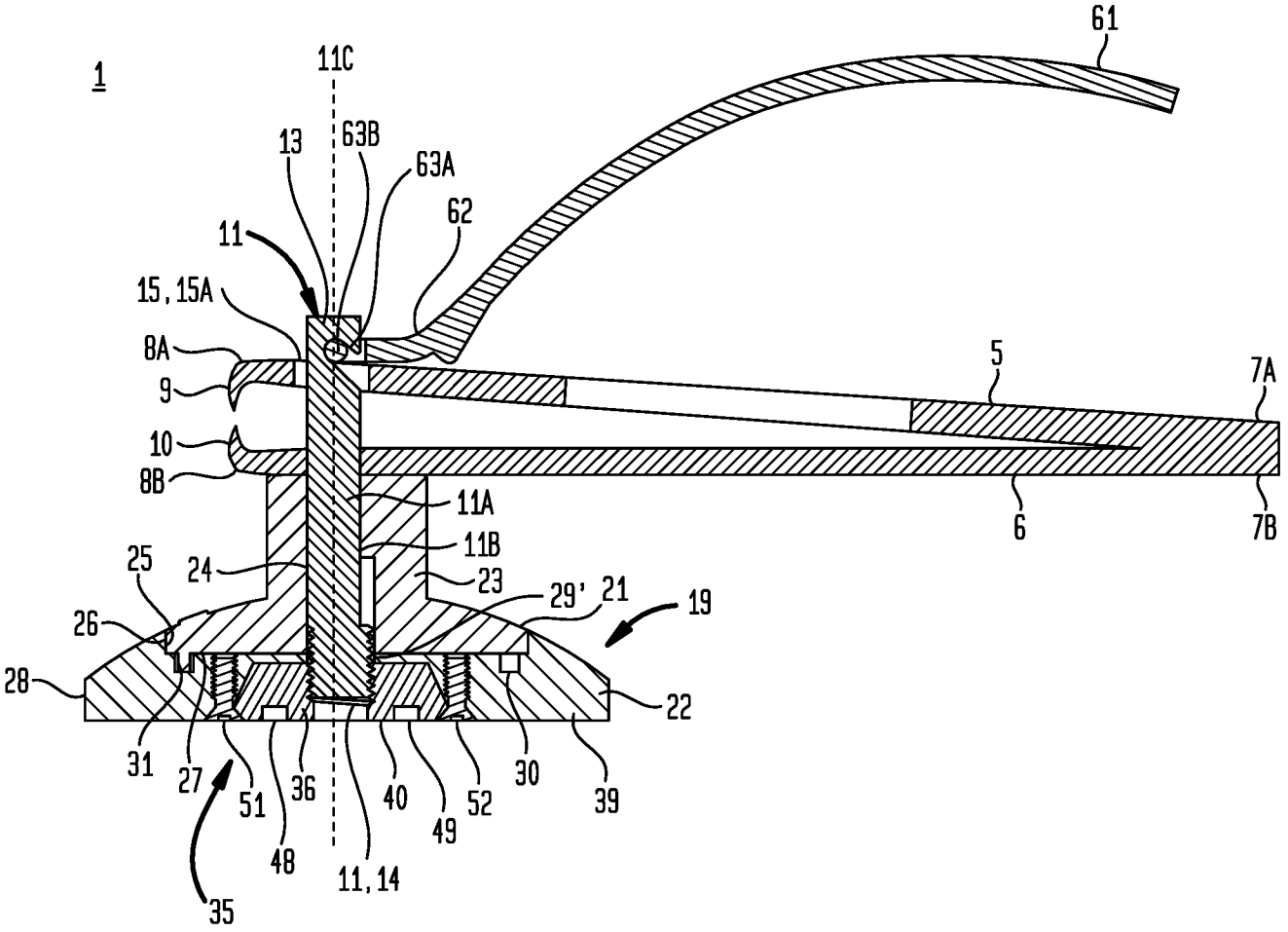
FIG. 11 is a cross section view 11-11 of the particular embodiment of the adjustable blade gap clipper shown in FIG. 10.
Figure 12:
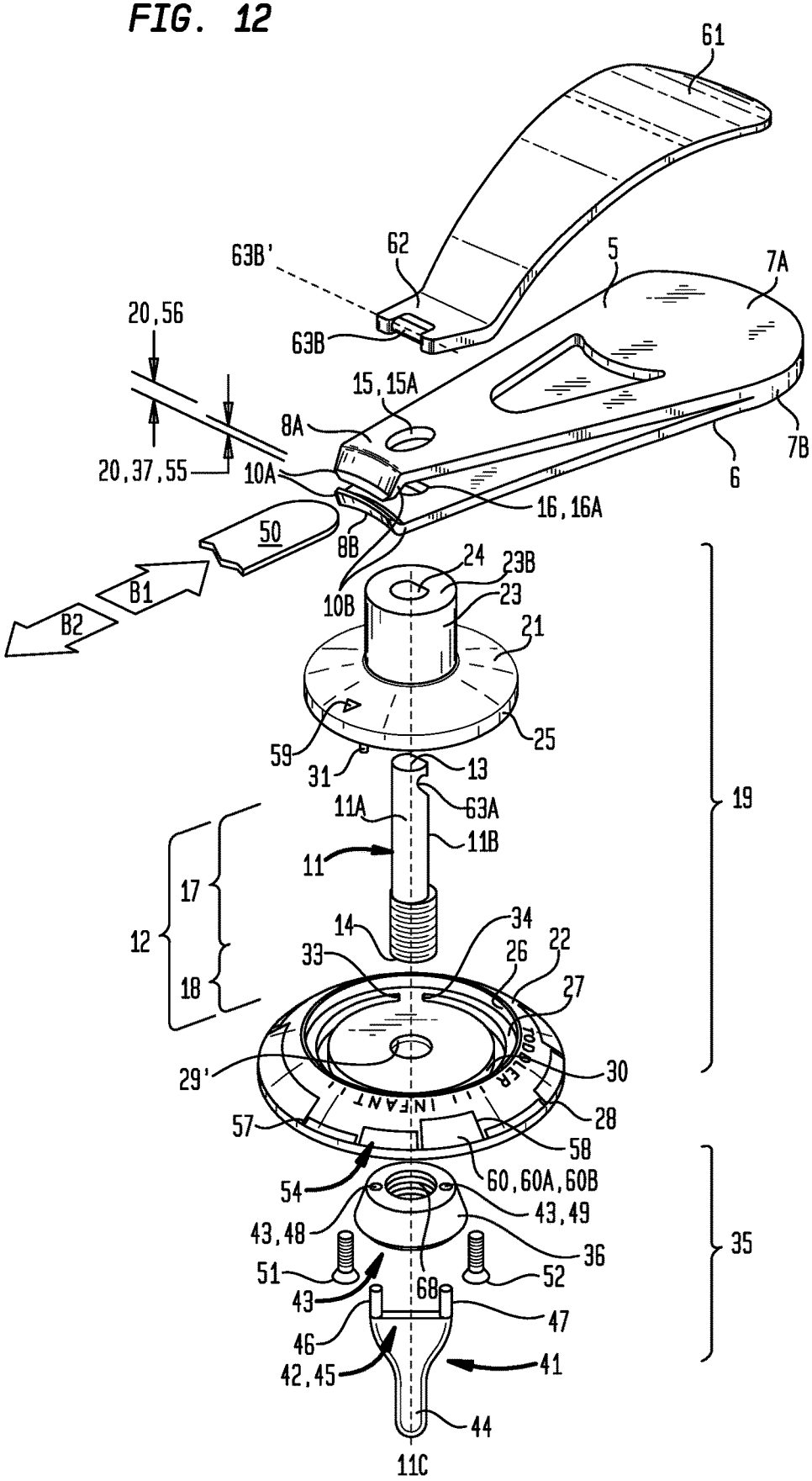
FIG. 12 is an exploded view of the particular embodiment of the adjustable blade gap clipper of FIGS. 10 through 11 further including the blade gap calibration member.

Now, with primary reference to FIGS. 8 and 9, in particular embodiments the blade gap adjustment assembly (19) can comprise a first annular member (21) and a second annular member (22). The first annular member (21) can be connected in fixed spatial relation to a spacer element (23) disposed between the first annular member (21) and the second leaf member (6). The first annular member (21) and the spacer element (23) include a radially inner annular wall (24) configured to slidably engage the post second end portion (18) while substantially barring rotation of the first annular member (21) and the spacer element (23) about the longitudinal axis (11C) of the post second end portion (18). In the illustrative example of FIGS. 8 and 9, the radially inner annular wall (24) defines a truncated circle (24A) which slidably engages the post (11) configured as a cylindrical member (11A) having a flat side (11B) and substantially bars rotation of the first annular member (21) and the spacer element (23) about the post longitudinal axis (11A). The spacer element (23) can have a spacer length (23A) disposed between a spacer first end (23B) engaged to the second leaf member (6) and a spacer second end (23C) connected to the first annular member (21). The spacer element (23) can be configured to dispose the blade gap adjustment assembly (19) in spaced apart relation to the first and second blades (9)(10) to allow insertion of a nail (2) in the blade gap (20) and can further be configured to contact the digit (3) to limit insertion of the digit (3) between the first and second blades (9)(10). The first annular member (21) can extend radially outward of the spacer element (23) to a radially outer circular annular wall (25). The second annular member (22) extends between a radially inner circular annular wall (26) bounding a closed bottom circular recess (27) and a radially outer annular wall (28). The first annular member (21) can be disposed in the closed bottom circular recess (27) having the radially outer circular wall (25) of the first annular member (21) disposed adjacent the radially inner circular wall (26) of the second annular member (22), whereby the second annular member (22) rotates (R1) about the first annular member (21). In particular embodiments as illustrated in the example of FIG. 8, a centrally located threaded aperture (29) in the closed bottom circular recess (27) of the second annular member (22) can be threadingly engaged to the post second end portion (18), whereby rotation (R1) of the second annular member (22) about the first annular member (21) moves (M1) the spacer element (23) in relation to the second leaf member (6) to increase or decrease the blade gap (20) between the first and second blades (9)(10).

Again, with primary reference to FIGS. 8 and 9, a closed end circular channel (30) can, but need not necessarily, be disposed in the closed bottom circular recess (27) of the second annular member (22). A pin (31) outwardly extending from the first annular member (21) slides within the closed end circular channel (30) upon rotation (R1) of the second annular member (22) about the first annular member (21). The pin (31) can engage a channel first closed end (33) or a channel second closed end (34) of the closed end circular channel (30) to delimit rotation (R1) of the second annular member (22) in the clockwise and counter-clockwise rotation about the first annular member (21) to an arc of less than 360 degrees. In particular embodiments, the second annular member (22) can be threadingly engaged to the post second end portion (18) whereby rotation of the second annular member (22) delimited by engagement of the pin (31) with the first and second closed ends (33)(34) of the closed end channel (30) can corresponding define a blade gap range (53) or useful operable variation in the blade gap (20) for an intended application of the adjustable blade clipper (1). Variation in the blade gap range (53) between applications of the adjustable blade clipper (1) can be accomplished by corresponding variation in the thread pitch of the threadingly engaged portions of the second annular member (22) and the post second end portion (18).

Now, with primary reference to FIGS. 10 through 13, embodiments can, but need not necessarily, include a blade gap calibration assembly (35). In the illustrative examples of FIGS. 10 through 13, the second annular member (22) can include a centrally located bore (29') in the closed bottom circular recess (27) through which the post second end portion (18) passes to threadingly engage a blade gap calibration member (36). The blade gap calibration member (36) threadingly engaged to the post second end portion (18) can be rotated (R2) discrete from rotation (R1) of the second annular member (22) about the first annular member (21). Rotation (R2) of the blade gap calibration member (36) moves (M2) the blade gap calibration member (36) along the post second end portion (18) to correspondingly move (M2) the first and second annular members (21)(22) to move the spacer element (23) in relation to the second leaf member (6) to thereby increase or decrease the blade gap (20) between the first and second blades (9)(10). The blade gap (20) can be adjusted by operation of the blade gap calibration member (36) to establish a calibrated distance (37) between the first and second blades (9)(10) useful with respect to subsequent adjustment of the blade gap (20) by rotation (R1) of the second annular member (22) delimited by engagement of the pin (31) with the channel first and second closed ends (33)(34) of the closed end circular channel (30). In particular embodiments, as shown in the illustrative example of FIG. 10, the blade gap calibration member (36) can be rotatably disposed in a second annular member base recess (38) of a second annular member base (39). The second annular member base recess (38) can be configured to receive the entirety of the blade gap calibration member (36) recessed or flush in relation to a second annular member base external surface (40).

Again, with primary reference to FIGS. 10 through 13, particular embodiments, of the blade gap calibration assembly (35) can, but need not necessarily, include blade gap calibration member rotation tool (41) (also referred to as the "tool"). The tool (41) and the blade gap calibration member (36) can include releasably mateable engaging portions (42)(43) (also referred to as the "tool engaging portion" and "calibration member engaging portion"). The tool engaging portion (42) can engage the calibration engaging portion (43) and the tool (41) can be turned to corresponding rotate (R2) the blade gap calibration member (36). In the illustrative example of FIGS. 10 through 13, the tool (41) includes a tool handle (44) terminating in a bifurcated engaging portion (45) have first and second prongs (46)(47). The first and second prongs (46)(47) can be structured to correspondingly insert into a pair of orifices (48)(49) disposed in the blade calibration member (36). The tool handle (44) with the first and second prongs (46)(47) engaged to the pair of orifices (48)(49) can be turned to correspondingly rotate (R2) the blade gap calibration member (36) to establish a calibrated distance (37) between the first and second blades (9)(10).

Figure 13:
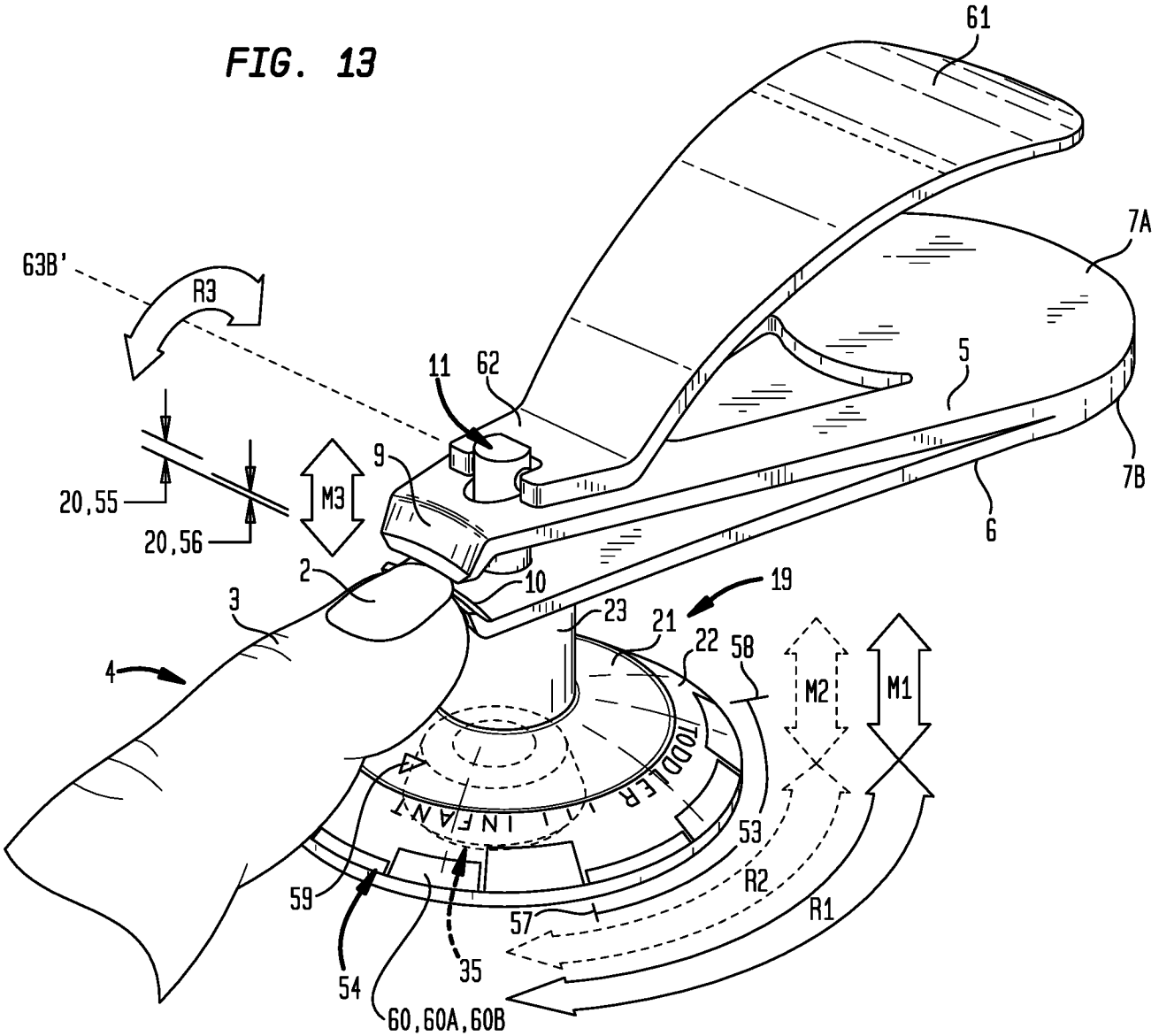
FIG. 13 illustrates a method of calibrating a blade gap, adjusting a blade gap and clipping a nail with the embodiments of the adjustable blade gap clipper.

Again, with primary reference to FIGS. 10 through 13, particular embodiments can, but need not necessarily, include a calibration blade (50). The calibration blade (50) (as shown in the example of FIG. 13) can be inserted between the first and second blades (9)(10) and the blade gap calibration member (36) rotated (R2) to engage the first and second blades (9)(10) with the calibration blade (50). The calibration blade (50) can be withdrawn to establish a calibrated distance (37) between the first and second blades (9)(10) substantially equal to the thickness of the calibration blade (50). The blade gap calibration member (36) can be subsequently fastened in fixed spatial relation to the second annular member (22). As shown in the illustrative example of FIG. 11, a pair of fasteners (51)(52) threadably mated with the second annular member (22) can rotationally engage the blade gap calibration member (35) to fasten the blade gap calibration member (35) in fixed spatial relation to the second annular member (22) of the blade gap adjustment assembly (19). The blade gap (20) having a calibrated distance (37) between the first and second blades (9)(10) allows the blade gap (20) to be subsequently adjusted through a preselected blade gap range (53) calibrated to incremental rotation (R1) of the second annular member (22) of the blade gap adjustment assembly (19) delimited by engagement of the pin (31) with the first and second closed ends (33)(34) of the closed end channel (30). In particular embodiments, a plurality of calibration blades (50) of differing thicknesses can be included allowing different calibrated distances (37) between the first and second blades (9)(10) to afford blade gaps (20) having correspondingly different blade gap ranges (53).

Now, with primary reference to FIGS. 1 through 6, 9 and 13, in particular embodiments, one or more blade gap indexes (54), can but need not necessarily, be circumferentially disposed on the second annular member (22) of blade gap adjustment assembly (19). A blade gap range (53) disposed between a first blade gap (55) and second blade gap (56) can be calibrated to blade gap index first and second end points (57)(58) of the blade gap index (54). Subsequent establishing the calibrated distance (37) between first and second blades (9)(10) of the blade gap (20) (as above described) the blade gap index first end point (57) can be aligned with blade gap index indicator (59) disposed on the first annular member (21) of the blade gap adjustment assembly (19). The blade gap calibration member (36) can subsequently fastened in fixed spatial relation to the second annular member (22) of the blade gap adjustment assembly (19), as above described. Subsequently, the second annular member (22) can then be rotated (R2) to align one of a plurality of indices (60) of a blade gap index (54) with the blade gap index indicator (59) to correspondingly increase or decrease the blade gap (20) in calibrated increments throughout the blade gap range (53) calibrated to the blade gap index (54). As shown in the illustrative example of FIG. 1, one or a plurality of blade gap indexes (54) (as shown in the example "infant", "toddler", "adolescent") can be disposed on the second annular member (22). Each blade gap index (54) can, but need not necessarily, include a plurality of indices (60) which can be incrementally spaced apart between blade gap index first and second end points (57)(58), wherein rotation (R1) of the second annular member (22) clockwise or counter clockwise through the arc of one of the plurality of indices (60) opens or closes the blade gap (20) one pre-established unit of distance having constant magnitude between each adjacent pair of the plurality of indices (60). As one illustrative example, if the first and second end points (57)(58) of an blade gap index (54) define one full rotation of the second annular member (22) and the plurality of indices (60) comprise numerical indices (60A) zero ("0") through nine ("9"), and where one full rotation of the second annual member (22) increases or decreases the blade gap (20) about 1.0 millimeter ("mm"), then clockwise or counter clockwise rotation of the annular grip member one numerical indices (60A) would increase or decrease the blade gap (20) about 0.1 millimeter. As an illustrative example, if the blade gap (20) associated with the numerical indices (60A) 0 disposes the first blade (9) in contact with second blade (10) (0.0 mm), then rotation of the second annular member (22) from a numerical index 0 to numerical index 4 affords a blade gap (20) of about 0.4 mm.

As illustrated in the example of FIGS. 1 through 6, in particular embodiments, the blade gap index (54) descriptive indices (60B) including a characteristic or a feature of an animal (4), such as: species, breed, age, sex, height, weight. In the example of FIG. 1, a plurality of blade gap indexes (54) include the specific example of descriptive indices (60B) of "infant", "toddler", "adolescent"; however, human age ranges (for example 1 month to 5 months, 6 months to 12 months, 2 years to 3 years, 4 years to 5 years . . . ) might also be utilized. In the instance of infants of humans or other animals (4), the size of the digits (3) and nails (2) can be especially small, and viewable blade gap indexes (54) which can be selected to generate a pre-determined blade gap (20) can be essential or necessitated to clip a nail(s) (2) without inadvertent cutting of the digit(s) (3). In particular embodiments, the blade gap indexes (54) can be removably disposed on the blade gap adjustment assembly (19). A plurality of blade gap indexes (54) can be provided as interchangeable layers (60C) can allow for interchangeable numerical indices (60A) or descriptive indices (60B) correlated with a blade gap (20) useful with different applications of the adjustable blade gap clipper (1).

Again, with general reference to FIGS. 1 through 13, embodiments can, but need not necessarily include, a leaf depressing lever (61) having a lever first end (62) rotatably coupled to a post first end portion (17). The leaf depressing lever (17) can rotate (R3) to engage the first leaf member (5) to correspondingly move (M30 the first blade (9) toward the second blade (10). In particular embodiments, the post (11) can, but need not necessarily, include a pivot bearing element (63A) disposed on the post first end portion (17) which engages a leaf depressing lever pivot (63B) disposed proximate the lever first end (62). The blade gap adjustment assembly (19) can be moved (M1) in relation to the post second end portion (18) to engage the second leaf member (6) to adjust the blade gap (20) between the first blade (9) opposite the second blade (10), and the leaf depressing lever first end (62) can rotate (R3) in the pivot bearing element (63A) disposed in the post first end portion (17) to increasingly engage the leaf depressing lever (61) with the first leaf member (5) to correspondingly move (M3) the first blade (9) toward the second blade (10) to clip a nail (2).

Now, with general reference to FIGS. 14 through 31, additional embodiments of the inventive adjustable blade gap clipper (1) can include one or more of the elements above described and with corresponding numerical reference in FIGS. 14 through 31, including one or more of first and second resilient leaf members (5)(6) connected at the first leaf ends (7A)(7B) and diverging outwardly approaching leaf second ends (8A)(8B), wherein the first and second resilient leaf members (5)(6) correspondingly include a first blade (9) and second blade (10) disposed in spaced apart opposed relation at the leaf second ends (8A)(8B). A post (11) having a length disposed between a post first end (13) and post second end (14) passes through first and second leaf member apertures (15)(16) correspondingly disposed in the first and second resilient leaf members (5)(6) proximate the first and second blades (9)(10). A pivot bearing element (63A) can be disposed on the post first end portion (17). A leaf depressing lever (61) can have a lever first end (62) having a leaf depressing lever pivot (63B) rotatably coupled in the pivot bearing element (63A) to engage the first resilient leaf member (5) to move the first blade (9) by depressing the first resilient leaf member (5). A blade gap adjustment assembly (19) moveable (M1) in relation to the post second end portion (18) engages the second resilient leaf member (6) to adjust the blade gap (20) between the first blade and the second blade (9)(10). A blade gap calibration member (36) can be moved (M2) in relation to the post first end portion (17) to establish a calibrated distance (37) between the first blade (9) and the second blade (10). While embodiments of the inventive nail clipper (1) share one or more of these features in common, each of these features can be reduced to practice in a wide variety of structure forms all of which are encompassed by the claimed generic elements of the inventive adjustable blade gap clipper (1). The illustrative examples which follow are sufficient in number to allow a person of ordinary skill in the art to make and use a numerous and wide variety of embodiments of the inventive nail clipper (1) which enable the full breadth of the claimed generic elements.

Figure 14:
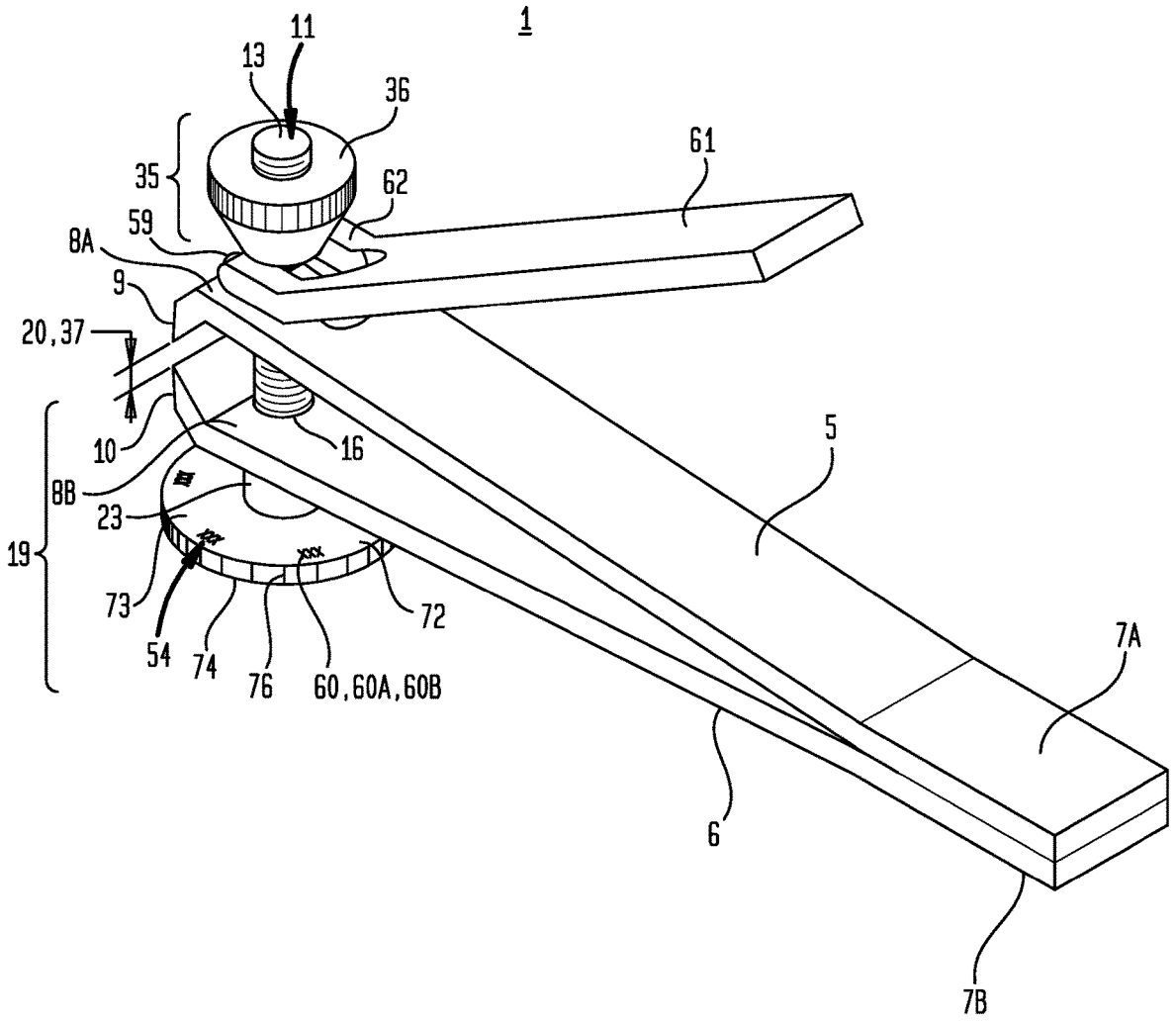
FIG. 14 is a perspective view of an embodiment of the adjustable blade gap clipper including a blade gap adjustment assembly and a blade gap calibration assembly.
Figure 15:
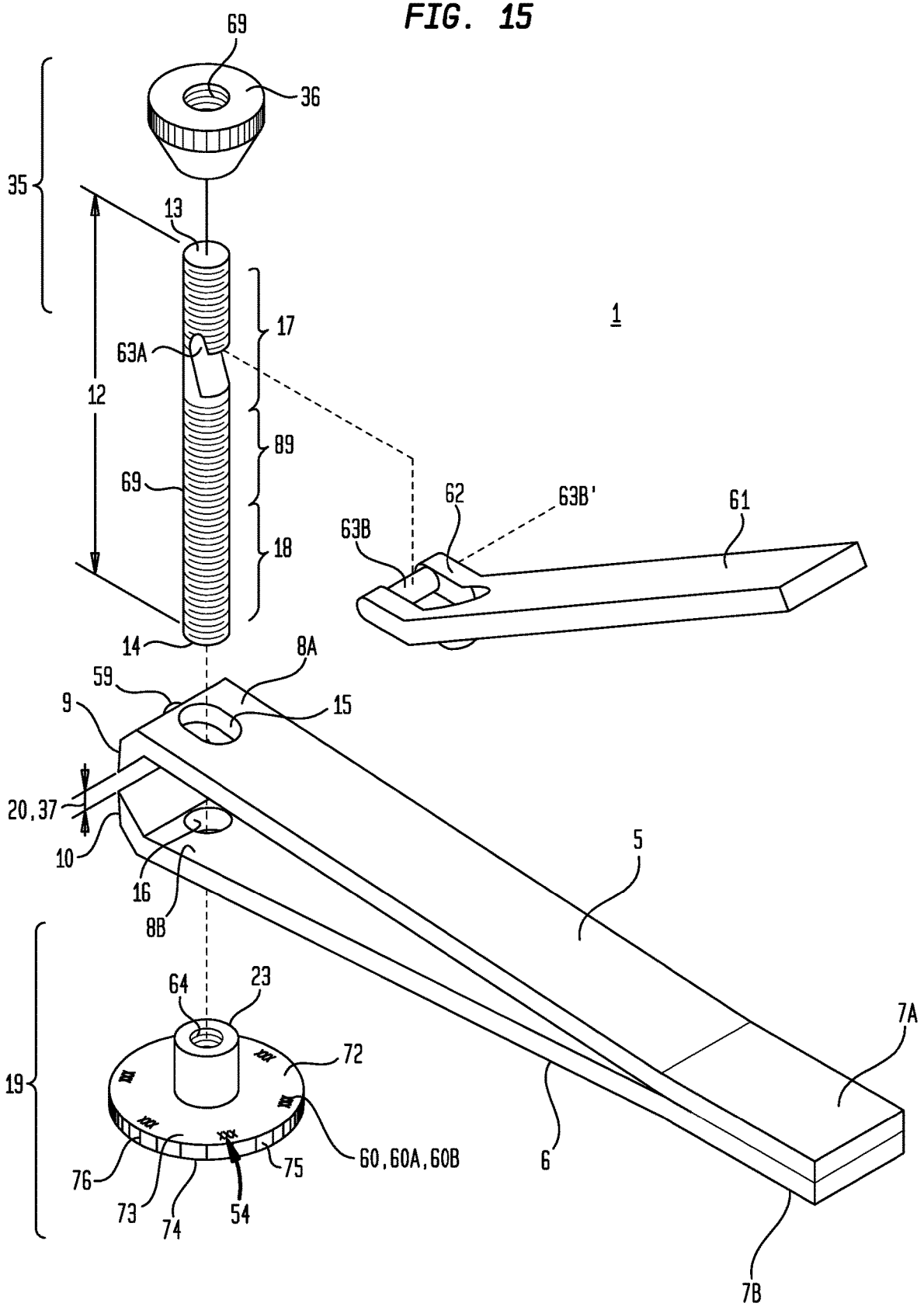
FIG. 15 is an exploded view of the embodiment of the adjustable blade gap clipper shown in FIG. 14.

Now, with primary reference to the illustrative example of FIGS. 14 and 15, the blade adjustment assembly (19) can include an blade gap adjustment member (72) connected in fixed spatial relation to the spacer element (23) having a spacer bore (64) threadably mated with the post second end portion (18). The blade gap adjustment assembly (19) moveable (M1) in relation to the post second end portion (18) engages the second resilient leaf member (6) to adjust a blade gap (20) between the first blade and the second blade (9)(10). A blade gap index (54) which can include a plurality of indices (60) ("xxx"), whether numeric indices (60A) or descriptive indices (60B)), can be disposed on the blade gap adjustment member first or second side (73)(74). Again, with primary reference to the illustrative example of FIGS. 14 and 15, a blade gap calibration assembly (35) can include, a blade gap calibration member (36) including a calibration member threaded bore (68) which rotatingly threadingly engages the post first end portion (17) extending outwardly of the pivot bearing element (63A). The blade gap calibration member (36) rotated (R2) in relation to the post first end portion (17) engages the lever first end (62) of the leaf depressing lever (61) to afford a calibrated distance (37) between the first blade (9) and the second blade (10).

Figure 16:
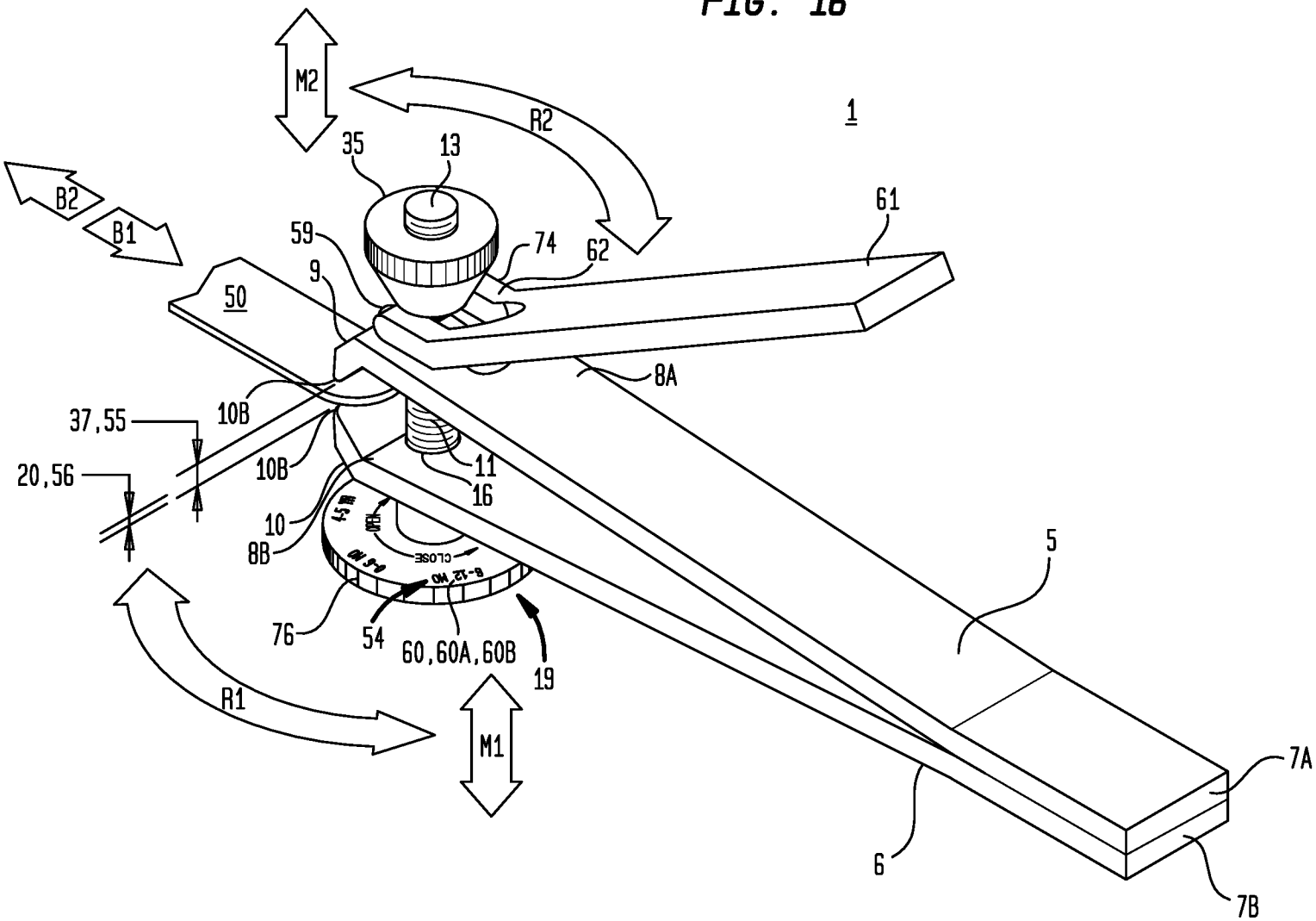
FIG. 16 illustrates a method of calibrating a blade gap and adjusting the blade gap in embodiments of the adjustable blade gap clipper.

Now, with primary reference to FIG. 16, an general method of using embodiments of the adjustable aperture clipper (1) and in particular to the embodiment illustrated in FIGS. 14 and 15, include one or more of: inserting a calibration blade (50) (B1) between a first blade (9) and a second blade (10), rotating (R2) a blade gap calibration adjustment member (36) to engage the first or second blade (9)(10) with the calibration blade (50) to afford a calibrated distance (37) between the first and second blades (9)(10) which calibrates the blade gap (20) with a blade gap index (54) having plurality of indices (60) alignable with a blade gap index indicator (59) disposed proximate the leaf second end (8A)(8B), removing the calibration blade (50) (B2) from between the first and second blades (9)(10), rotating (R1) a blade gap adjustment assembly (19) between blade gap index first and second end points (57)(58) to move (M1) the blade gap assembly in relation to the post second end portion (18) to incrementally adjust the blade gap (20) to one of the plurality of indices (60) of the blade gap index (54), or combinations thereof.

Figure 17:
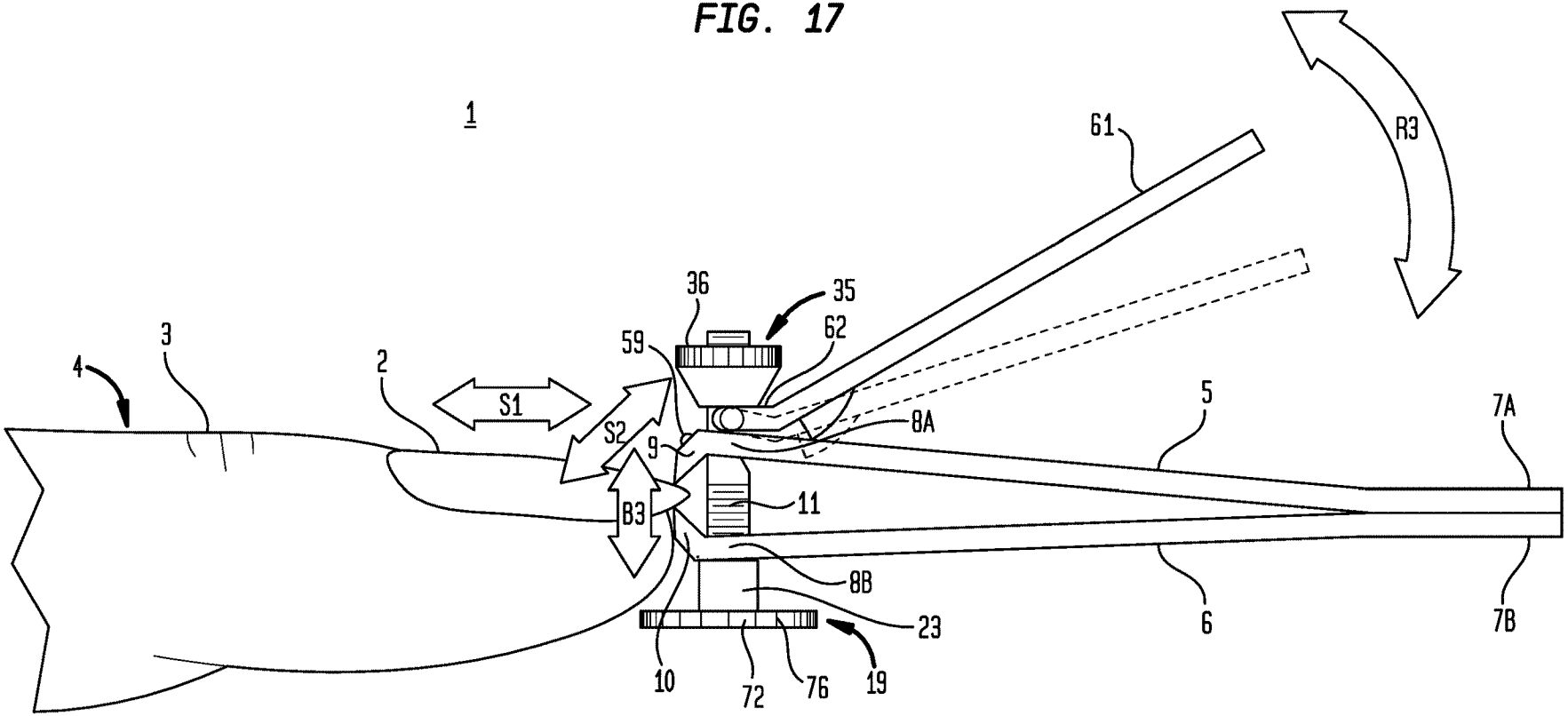
FIG. 17 illustrates a method of clipping a nail with the embodiments of the adjustable blade gap clipper.

Now, with primary reference to FIG. 17, a method of using embodiments of the adjustable aperture clipper (1) to cut a nail (2) extending from a digit (3) of an animal (4) in general and in particular to the embodiment illustrated in FIGS. 14 and 15, can include one or more of: axially sliding a nail (S1) or laterally sliding (S2) in relation to a first blade and a second blade to dispose the nail (2) between a first blade and a second blade (9)(10), rotating (R3) a leaf depressing lever (61) to engage the first leaf member (5) to correspondingly close (B3) a blade gap (20) between the first blade (9) and the second blade (10) to clip and allow removal of a portion of the nail (2).

Figure 18:
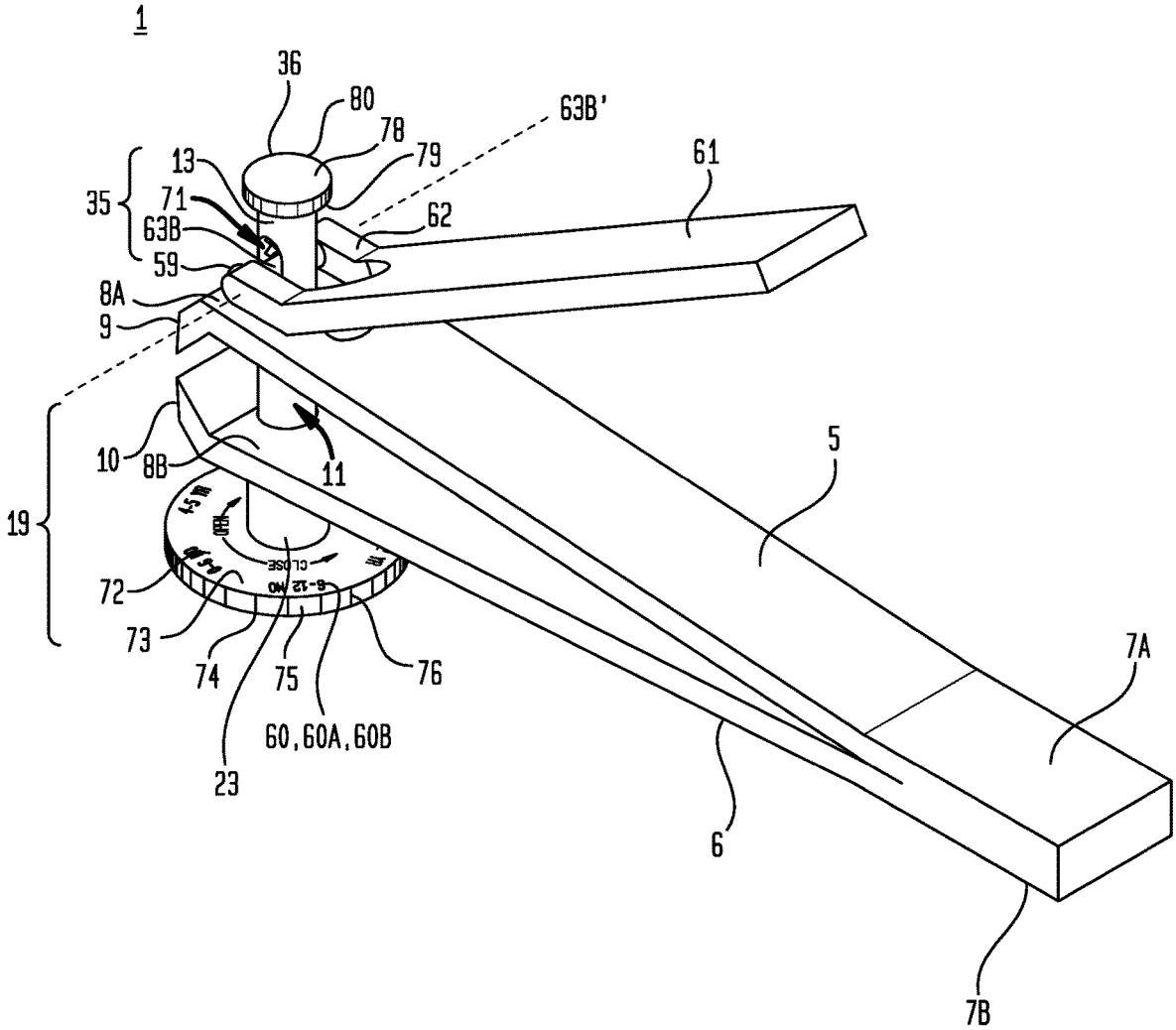
FIG. 18 is a perspective view of an embodiment of the adjustable blade gap clipper including a blade gap adjustment assembly and a blade gap calibration assembly.
Figure 19:
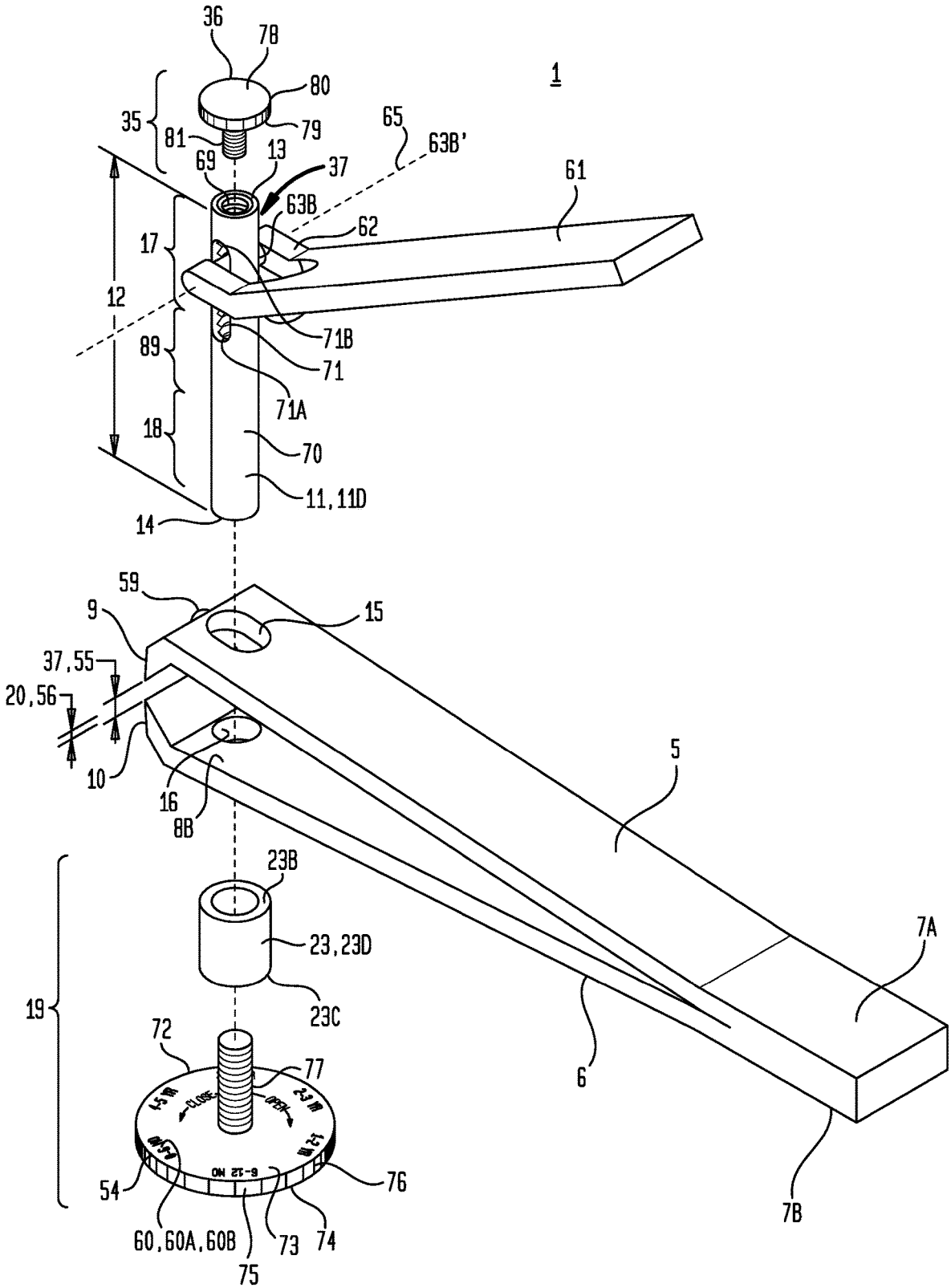
FIG. 19 is an exploded view of the embodiment of the adjustable blade gap clipper shown in FIG. 18.

Now, with primary reference to FIGS. 18 and 19, in particular embodiments of the inventive adjustable blade gap clipper (1), the post (11) can comprise a post tubular member (11D) having a threaded internal surface (69) and a post unthreaded external surface (70). A pivot bearing element (63A) in the form of an elongate slot (71) can be axial disposed in the post first end portion (17). A leaf depressing lever (61) can have a lever first end (62) including leaf depressing lever pivot (63B). The leaf depressing lever pivot (63B) can be pivotally disposed in the elongate slot (71). The leaf depressing lever (61) can rotate about a pivot axis (63B') of the leaf depressing lever pivot (63B) to engage the first resilient leaf member (5) to move the first blade (9) by depressing the first resilient leaf member (5). The blade gap adjustment assembly (19) can comprise a blade gap adjustment member (72) having radially extending member first and second sides (73)(74) joined at a grippable member edge (75) grippable by the digits (3). The grippable member edge (75) can, but need not necessarily, include patterned surface elements (76) to enhance grip with the digits (3). The term "patterned surface elements" means a surface having a pattern (76) with at least two areas which differ in physical structure, and without sacrificing the breadth of the foregoing definition, the differences may be due to the difference in depth of the surface structure, the difference in lateral density of the surface structure, the periodicity of the surface structure, the isotropy or anisotropy of the surface structure, the direction of the anisotropy axis of the surface structure, or combinations thereof, and specifically as illustrative examples includes: knurling, small protuberances, excrescence, series of small ridges, beads, or concavities disposed on a surface. The blade gap adjustment member (72) can further include a blade gap index (54) including a plurality of indices (60), as above described, disposed on the member first or second side (73)(74). The blade gap adjustment member (72) further includes an externally threaded member (77) outwardly extending from the member first side (73). A spacer element (23) having a tubular body (23C) can slidably engage the post second end portion (18) with a spacer first end (23A) engaging the second resilient leaf member (6). The externally threaded member (77) of the blade gap adjustment member (70) rotatably (R1) engages the post threaded internal surface (69) to rotatingly engage the blade gap adjustment member (72) with the spacer second end (23B). Subsequent rotation of the blade gap adjustment member (72) moves (M1) the spacer element (23) along the post second end portion (18) to adjust the blade gap (20). The blade gap calibration adjustment assembly (35) can include a blade gap calibration member (36) having radially extending calibration member first and second sides (78)(79) joined at a grippable calibration member edge (80). The blade gap calibration member (36) further includes an outwardly extending calibration member threaded member (81). The calibration member threaded member (81) rotatably engages the post threaded internal surface (69). Rotation of the calibration member threaded member (81) in relation to the post threaded internal surface (69) correspondingly moves the leaf depressing lever pivot (63B) between opposite slot ends (71A)(71B) in the elongate slot (71). The leaf depressing lever pivot (63B) corresponding engages the first resilient leaf member (5) to correspondingly increase or decrease the calibrated distance (37) between first and second blades (9)(10).

Figure 20:
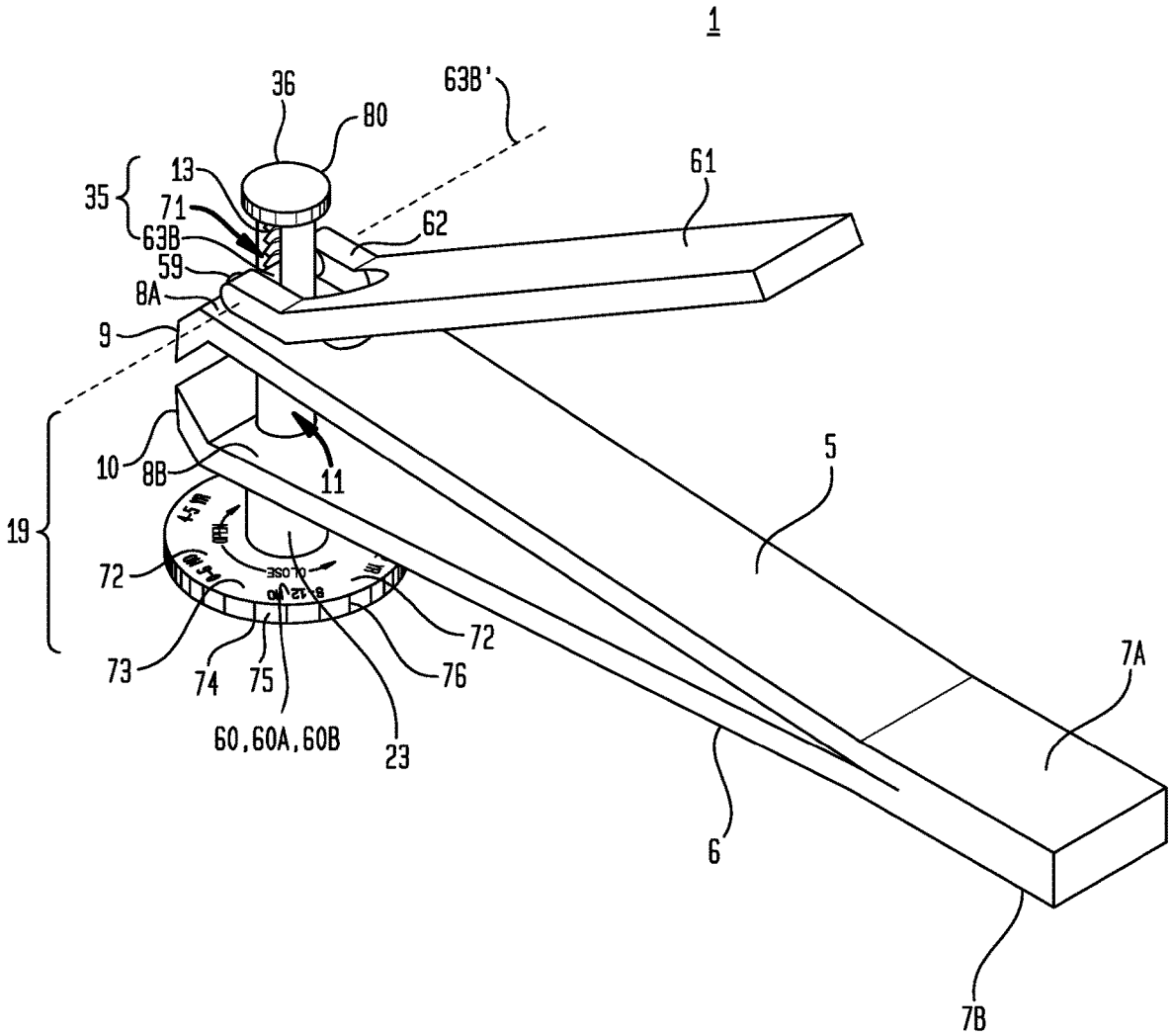
FIG. 20 is a perspective view of an embodiment of the adjustable blade gap clipper including a blade gap adjustment assembly and a blade gap calibration assembly.
Figure 21:
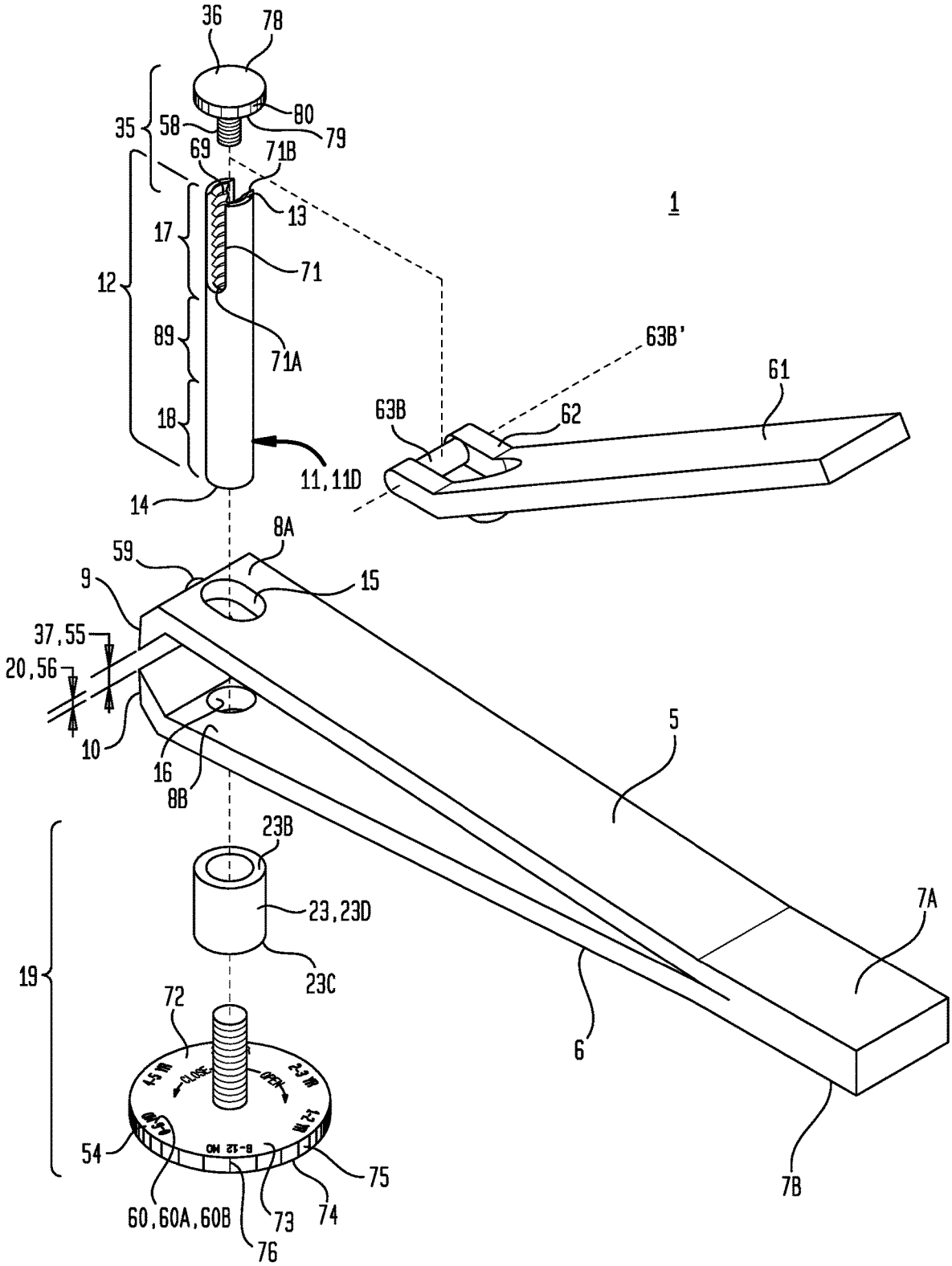
FIG. 21 is an exploded view of the embodiment of the adjustable blade gap clipper shown in FIG. 20.

Now, with primary reference to FIGS. 20 and 21, particular embodiments of the inventive adjustable blade gap clipper (1) can include one or more of the elements above described and shown in FIGS. 18 and 19, the post (11) can include a post tubular member (11D) having a post threaded internal surface (69) and having a post length (12) disposed between a post first end (13) and post second end (14). The elongate slot (71) axial disposed in the post first end portion (17) can have a slot first end (71A) opposite a slot second end (71B) open at the post first end (13). The post (11) can pass through the first and second leaf member apertures (15)(16) correspondingly disposed in the first and second resilient leaf members (5)(6) proximate the first and second blades (9)(10). The leaf depressing lever pivot (63B) can be disposed in the elongate slot (71), The blade gap calibration member (36) can close the slot second end (71B) by rotatable engagement of the calibration member threaded member (81) with the post threaded internal surface (69). The calibration member threaded member (81) can engage the leaf depressing lever pivot (63B) to provide a pivot bearing element (63A). Rotation (R2) of the calibration member threaded member (81) in relation to the post threaded internal surface (69) correspondingly moves (M2) the leaf depressing lever pivot (63B) between opposite slot ends (71A)(71B) in the elongate slot (71). The leaf depressing lever pivot (63B) corresponding engages the first resilient leaf member (5) to correspondingly increase or decrease the calibrated distance (37) between the first and second blades (9)(10).

Figure 22:
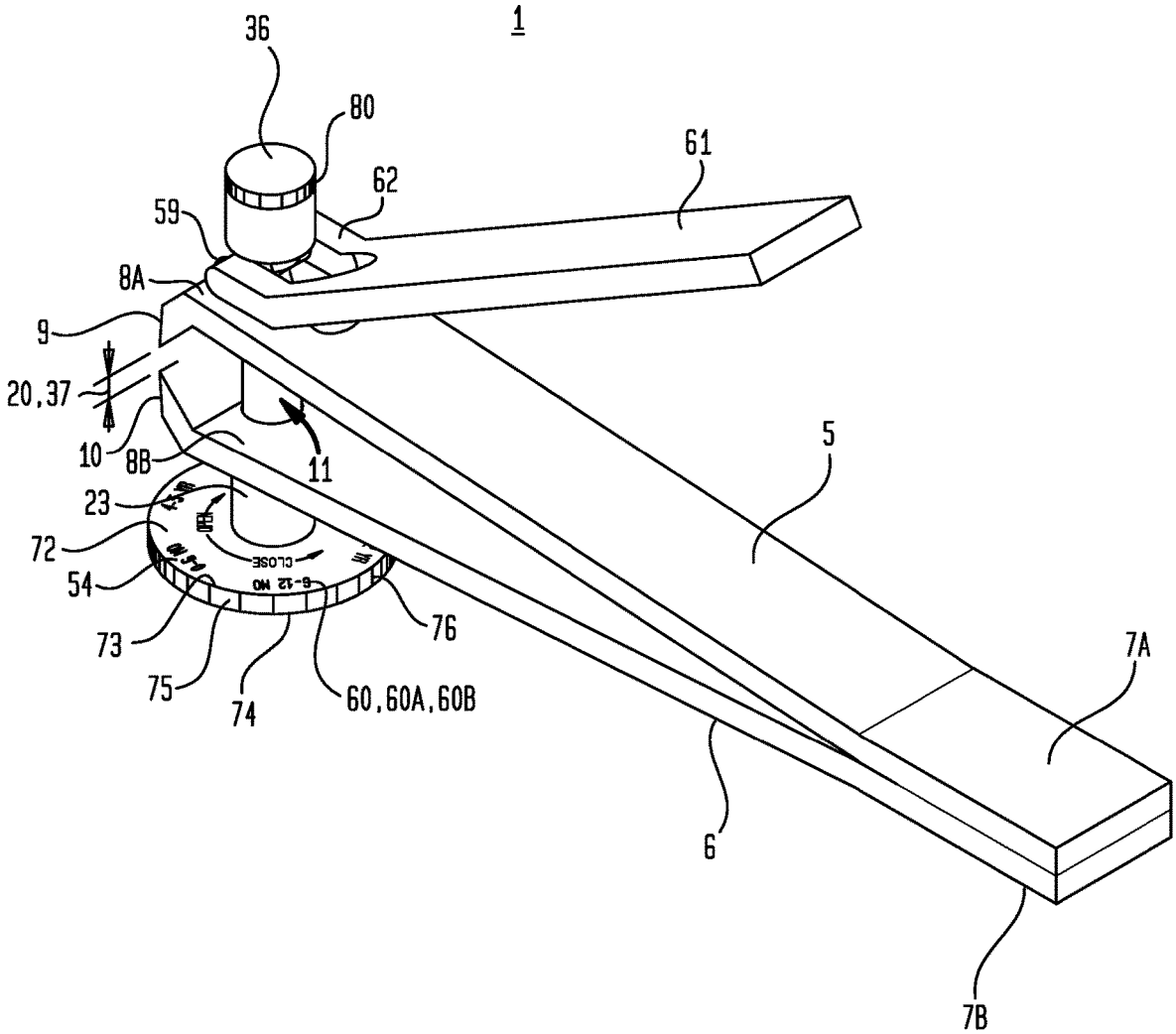
FIG. 22 is a perspective view of an embodiment of the adjustable blade gap clipper including a blade gap adjustment assembly and a blade gap calibration assembly.
Figure 23:
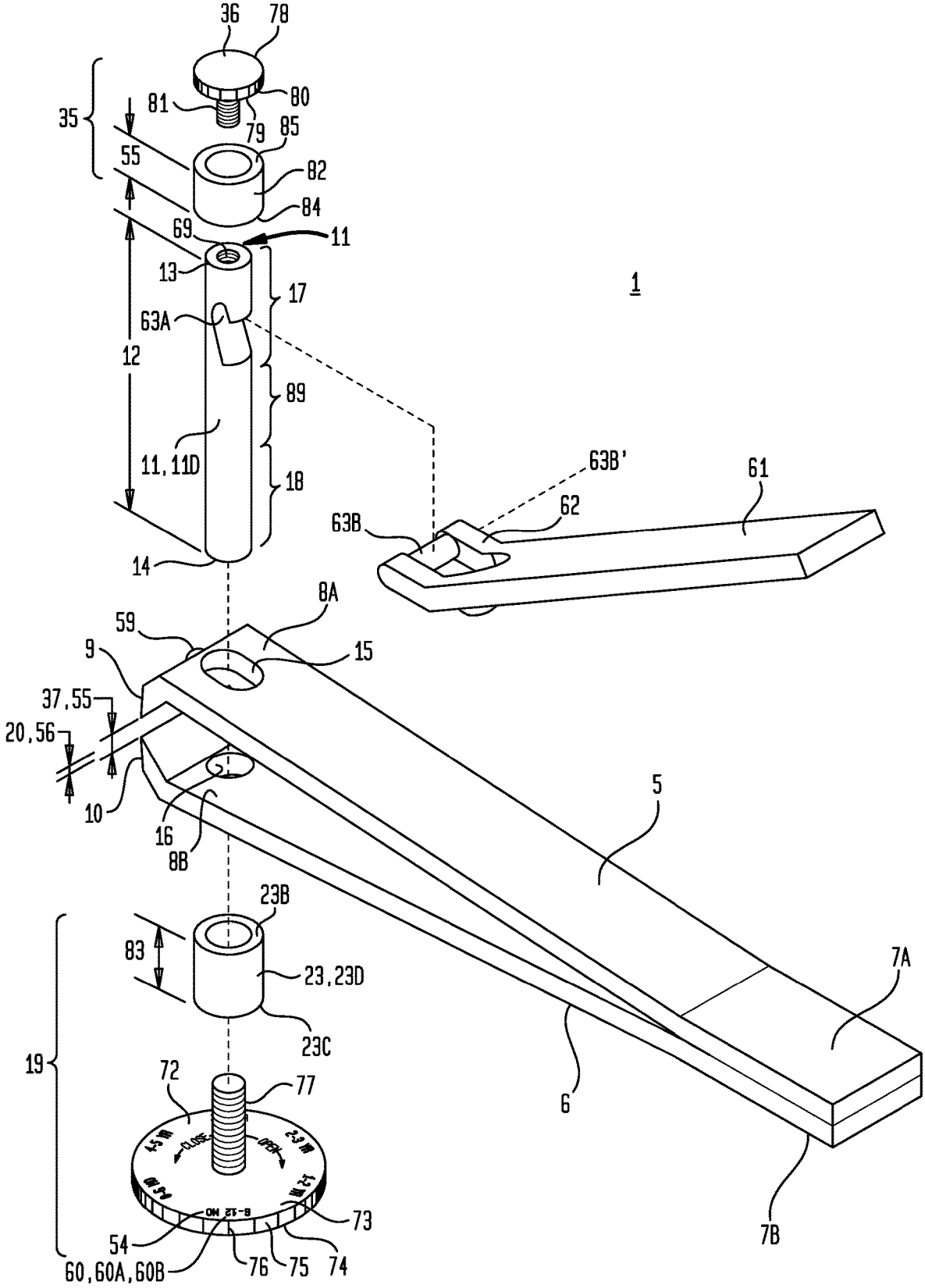
FIG. 23 is an exploded view of the embodiment of the adjustable blade gap clipper shown in FIG. 22.

Now, with primary reference to FIGS. 22 and 23, particular embodiments of the inventive adjustable blade gap clipper (1) can include one or more of the elements above described and shown in FIGS. 20 and 21. In the illustrative examples of FIGS. 22 through 23, a post (11) comprises a post tubular member (11D) having a post threaded internal surface (69). The post (11) has a post length (12) disposed between a post first end (13) and post second end (14) which passes through first and second leaf member apertures (15)(16) correspondingly disposed in the first and second resilient leaf members (5)(6) proximate the first and second blades (9)(10). A pivot bearing element (63A) can be disposed on the post first end portion (17). A leaf depressing lever (61) can have a lever first end (62) having a leaf depressing lever pivot (63B) rotatably coupled in the pivot bearing element (63A) to engage the first resilient leaf member (5) to move the first blade (9) by depressing the first resilient leaf member (5). A blade gap adjustment assembly (19), as above described, moveable in relation to the post second end portion (18) engages the second resilient leaf member (6) to adjust the blade gap (20) between the first blade and the second blade (9)(10). The blade gap calibration adjustment assembly (35) in the example of FIGS. 22 and 23, includes a blade gap calibration member (36), as above described, and further including a tubular calibration spacer (82) having a calibration spacer length (83) disposed between calibration spacer first and second ends (84)(85). The calibration spacer (82) can slidably engage the post first end portion (17) to engage the calibration spacer first end (84) with the first resilient leaf member (5). The calibration member threaded member (81) can rotatably engage the post threaded internal surface (69) to engage the blade gap calibration member (36) with the calibration spacer second end (85). Rotation of the blade gap calibration member (36) corresponding increases or decreases the calibrated distance (37) between the first and second blades (9)(10).

Figure 24:
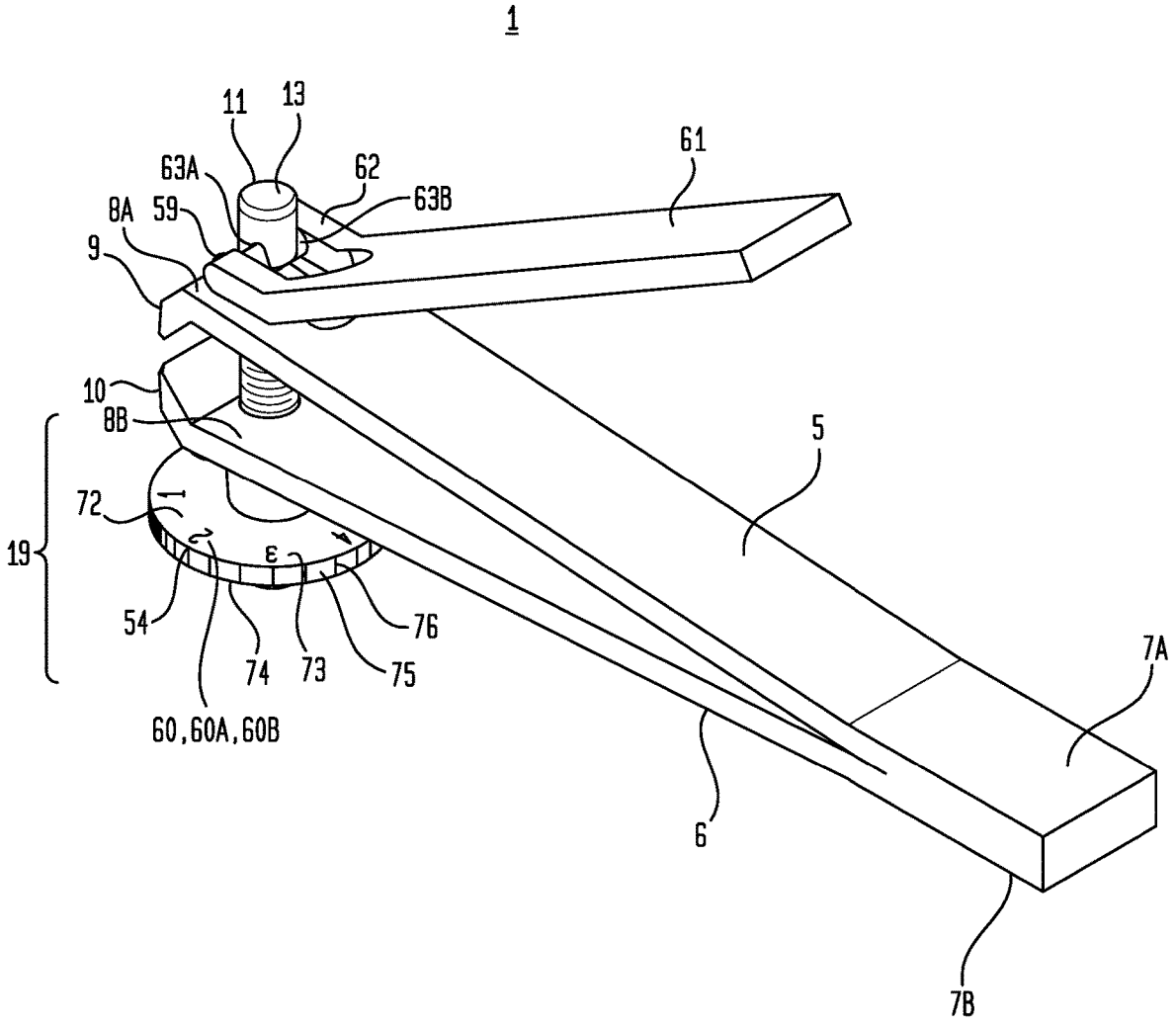
FIG. 24 is a perspective view of an embodiment of the adjustable blade gap clipper including a blade gap adjustment assembly.
Figure 25:
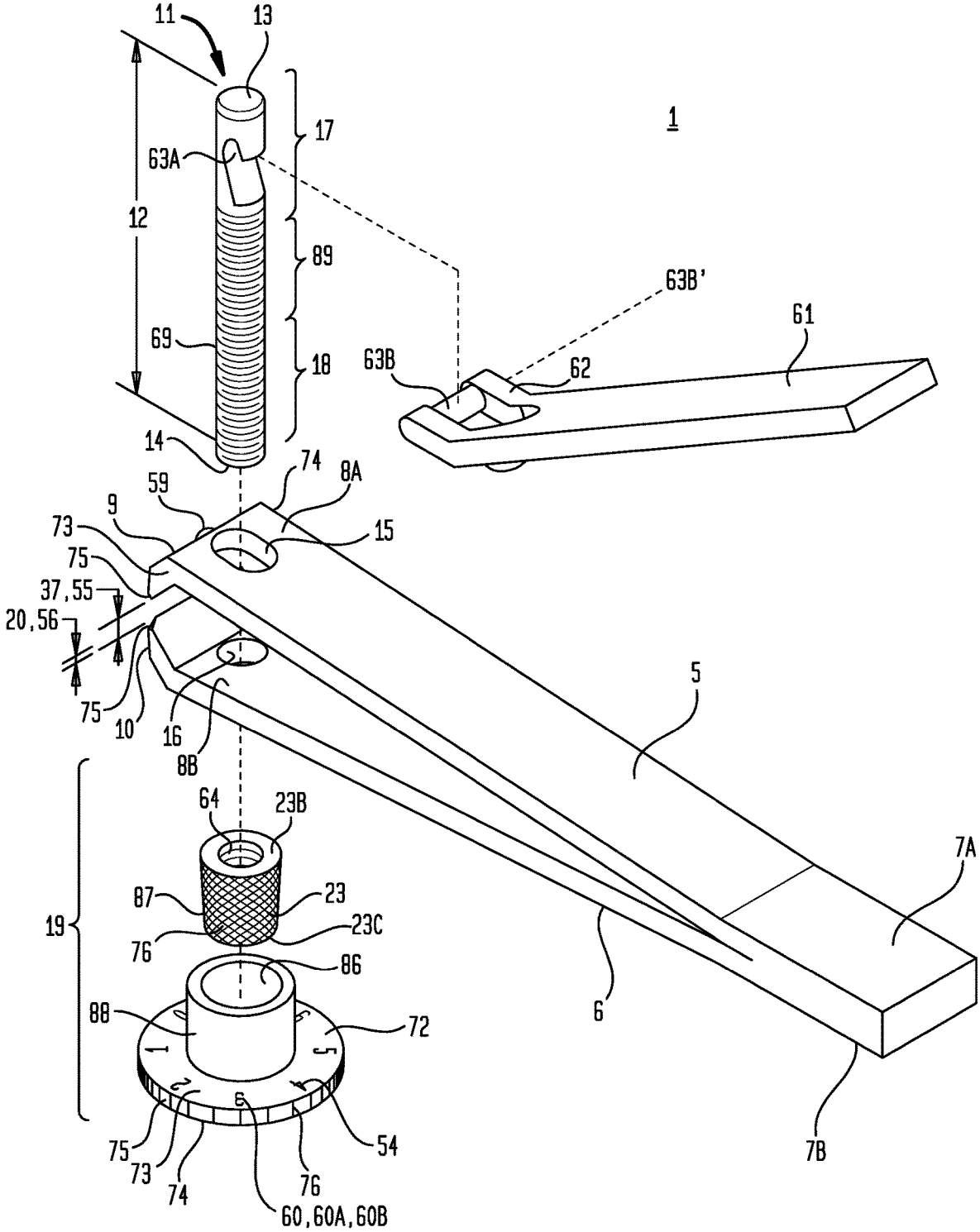
FIG. 25 is an exploded view of the embodiment of the adjustable blade gap clipper shown in FIG. 24.

Now with primary reference to FIGS. 24 and 25, in particular embodiments, the blade gap adjustment assembly (19) can include the blade gap adjustment member (72) which couples in adjustable spatial relation to a spacer element (23) having a threaded spacer bore (64) which threadably mates with the post second end portion (18). In particular embodiments, the spacer (23) can be configured to interference fit in a blade gap adjustment member aperture (86) of the blade gap adjustment member (72). In particular embodiments, a spacer external surface (87) can, but need not necessarily, include patterned surface elements (76) which can enhance the interference fit between spacer external surface (87) and the blade gap adjustment member aperture (86). In particular embodiments, the blade gap adjustment member (72) can, but need not necessarily, include a tubular extension (88) affording the blade gap member aperture (86) which slidably receives the spacer (23) by forcible urging to allow an enhanced interference fit between the corresponding surfaces. For the purposes of this invention, the term "interference fit", also known as a press fit or a friction fit, fastens two parts by friction after the parts are pushed together. The advantage of interference fit in the instant embodiment can be to establish a calibrated distance (37) between the first and second blades (9)(10) by rotational threaded engagement of the spacer bore (64) with the post threaded external surface (67). The blade gap adjustment member (72) can then be interference fit to the spacer (23) to calibrate the blade gap (20) to a blade gap index (54) having a plurality of indices (60). As one illustrative example, the clipper (1) with the blade gap (20) established at a calibrated distance (37) between the first and second blades (9)(10) by rotation of the spacer (23) can then have the blade gap adjustment member (72) interference fit to the spacer (23) having a desired one of the plurality of indices (60) of a blade gap index indicator (59) aligned with a blade gap index indicator (59).

Figure 26:
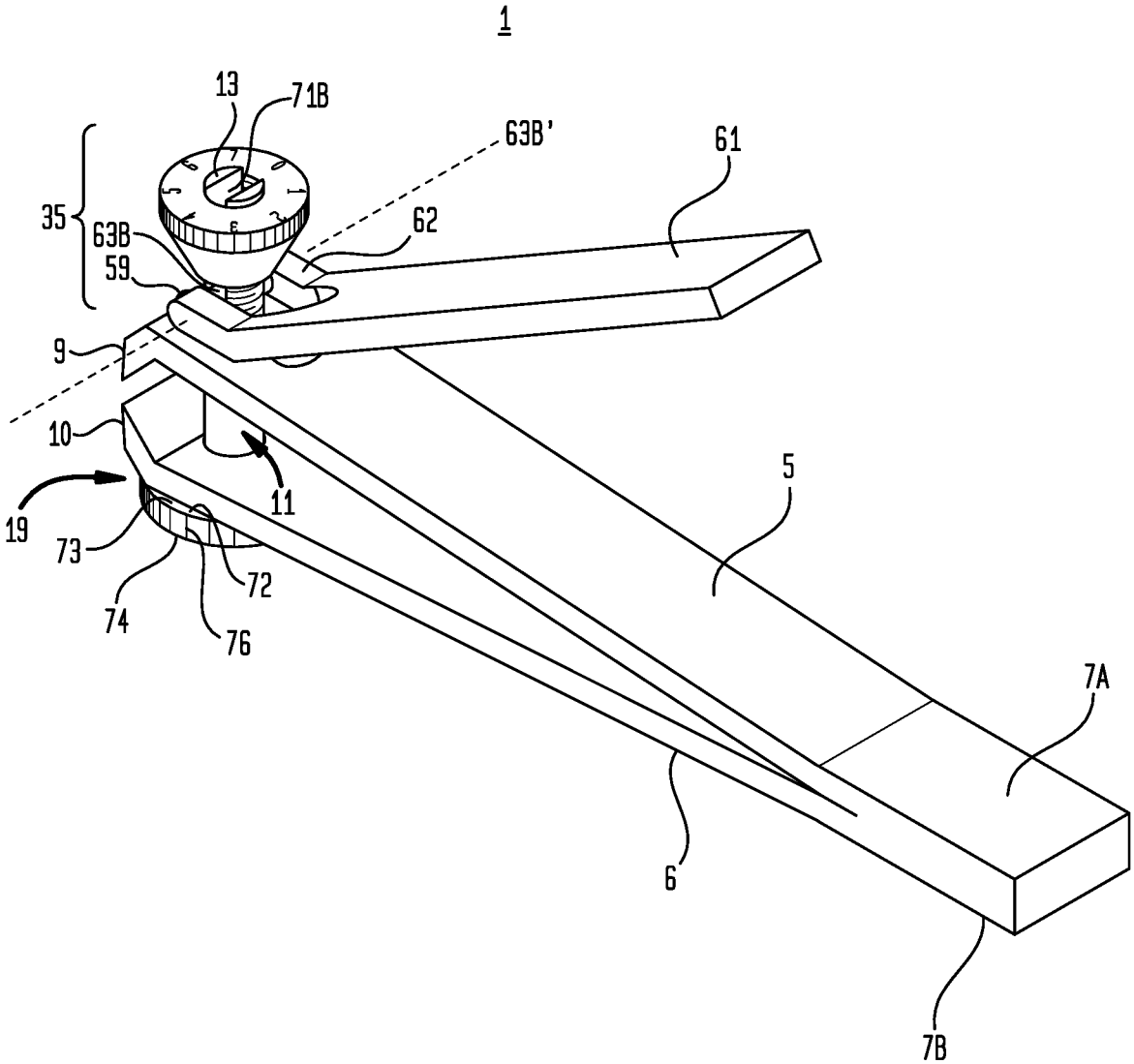
FIG. 26 is a perspective view of an embodiment of the adjustable blade gap clipper including a blade gap adjustment assembly and a blade gap calibration assembly.
Figure 27:
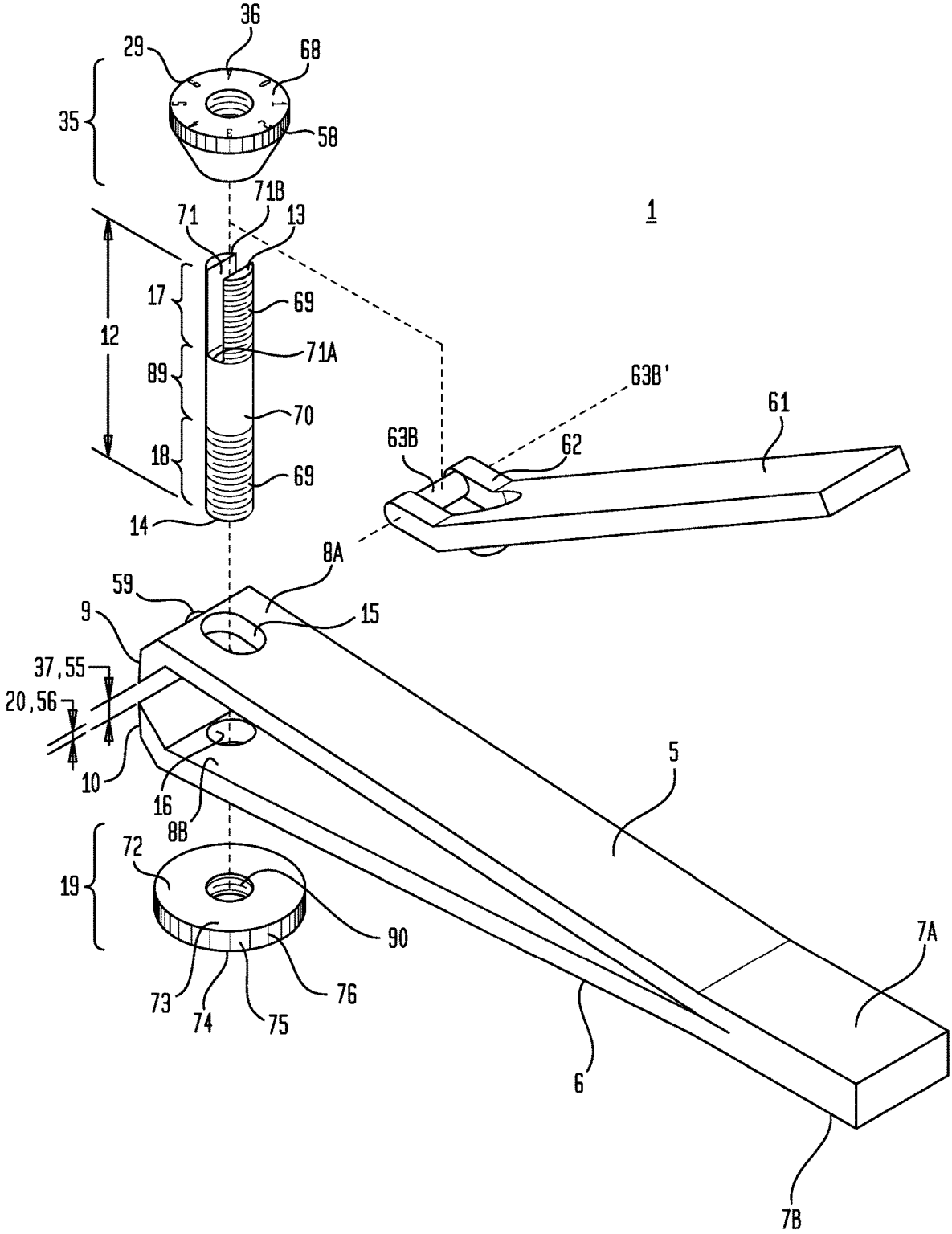
FIG. 27 is an exploded view of the embodiment of the adjustable blade gap clipper shown in FIG. 26.

Now, with primary reference to FIGS. 26 and 27, in particular embodiments, the post (11) can afford a post threaded external surface (69) on the post first end portion (17) and post second end portion (18) and a post medial portion (89) affording a post unthreaded external surface (70). The post (11) can pass through the first and second leaf member apertures (15)(16) correspondingly disposed in the first and second resilient leaf members (5)(6) proximate the first and second blades (9)(10) to allow the first leaf member (5) to travel in relation to the post unthreaded external surface (70) and to dispose the post treaded external surface (69) proximate the first and second post ends (13)(14) to correspondingly outwardly extend from the first and second leaf resilient members (5)(6). An elongate slot (71) can be axial disposed in the post first end portion (17). The elongate slot (71) can have a slot first end (71A) opposite a slot second end (71B) open at the post first end (13). The leaf depressing lever pivot (63B) can be disposed in the elongate slot (71), The calibration adjustment assembly (35) including a blade gap calibration member (36) can rotatably engage the post threaded external surface (69) of post first end portion (17) to provide a pivot bearing element (63A). Rotation of the calibration member (36) in relation to the post threaded external surface (69) correspondingly moves the leaf depressing lever pivot (63B) between opposite slot ends (71A)(71B) in the elongate slot (71) and correspondingly increases or decreases the calibration distance (37) between the first and second blades (9)(10) to establish the blade gap (20). The blade gap adjustment assembly (19) can be configured as a blade gap adjustment member (72) having a radially inner annular threaded wall (90) and blade gap adjustment member first and second sides (73)(74) joined at a grippable member edge (75). The radially inner annular threaded wall (90) can rotatingly engaged to the post threaded external surface (69) of the post second end portion (18). The blade gap adjustment member (72) can further include a blade gap index (54) having a plurality of indices (60) disposed on the member first or second side (73)(74) which can be rotatably aligned with a blade gap index indicator (59). In particular embodiments, the blade gap index (54) can be aligned with the blade gap index indicator (59) and a calibration blade (50) can be inserted between the first and second blades (9)(10) and the calibration member (36) rotated to engage the first and second blades (9)(10) with the calibration blade (50). The calibration blade (50) can be withdrawn to establish a calibrated distance (37) between the first and second blades (9)(10) to calibrate a blade gap (20) to the blade gap index (54).

Figure 28:
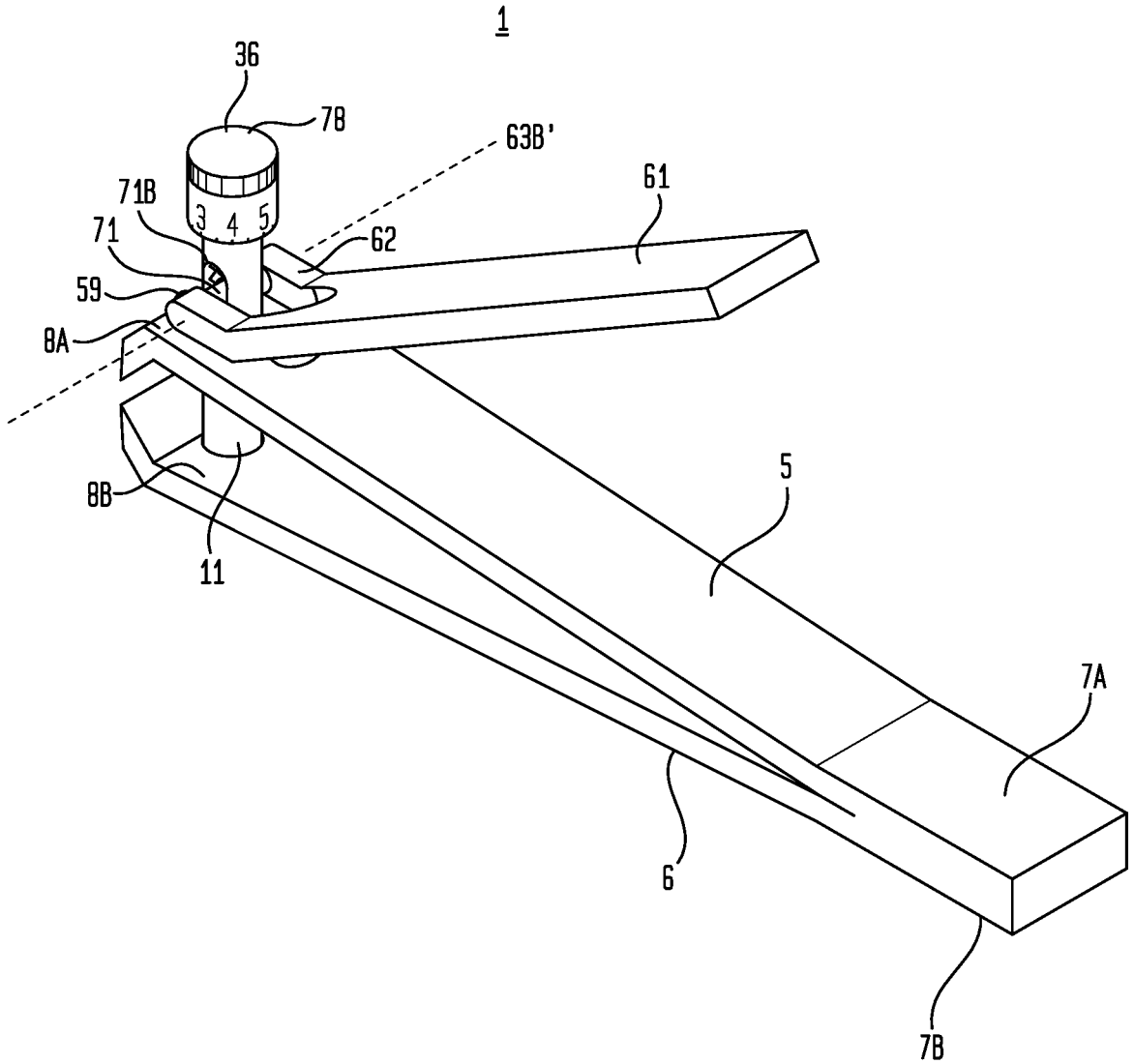
FIG. 28 is a perspective view of an embodiment of the adjustable blade gap clipper including a blade gap calibration assembly.
Figure 29:
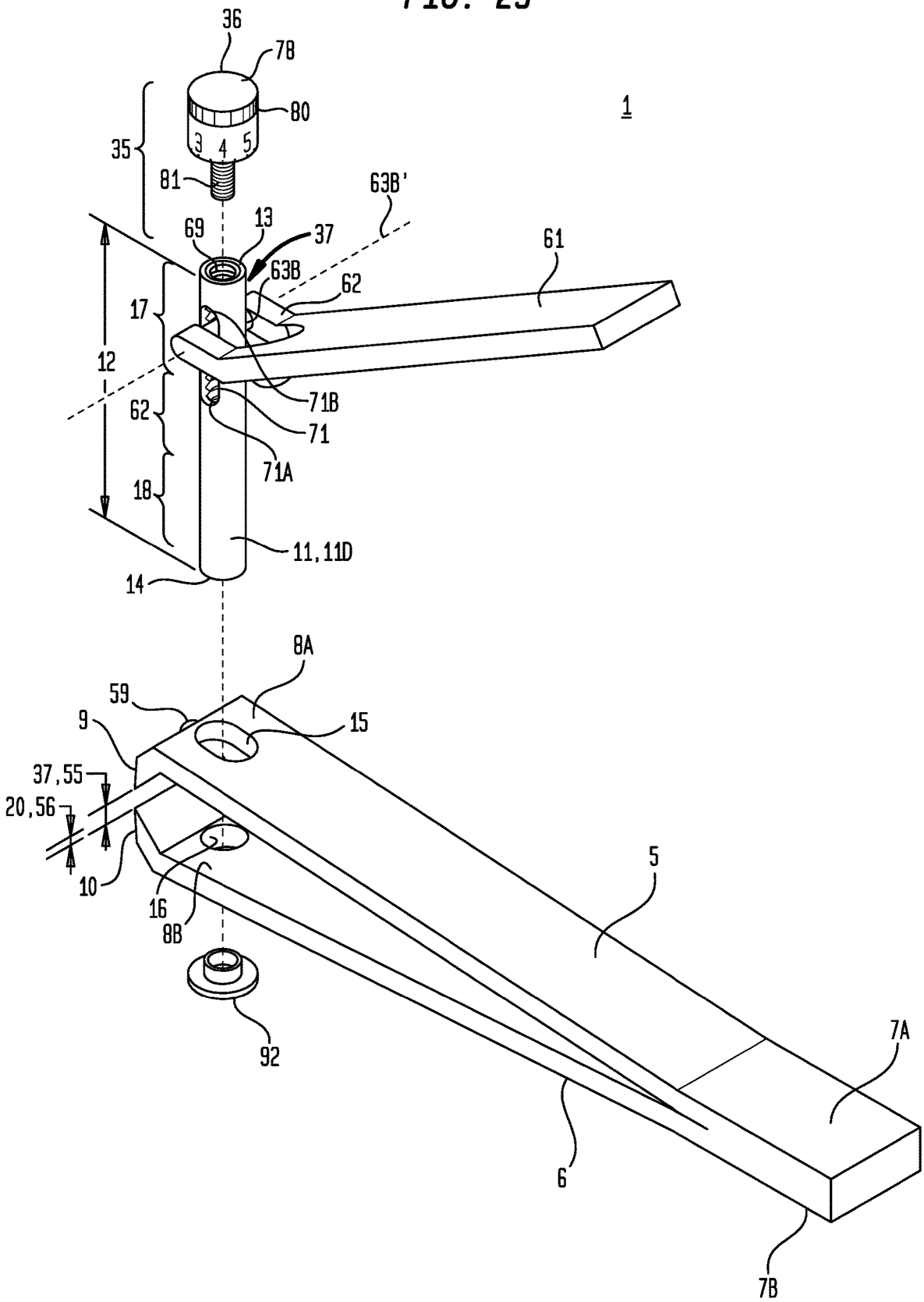
FIG. 29 is an exploded view of the embodiment of the adjustable blade gap clipper shown in FIG. 28.

Now, with primary reference to FIGS. 28 and 29, particular embodiments of the inventive adjustable blade gap clipper (1) can include first and second resilient leaf members (5)(6) connected at the first leaf ends (7A)(7B) and diverging outwardly approaching leaf second ends (8A)(8B). The first and second resilient leaf members (5)(6) correspondingly include a first blade (9) and second blade (10) disposed in spaced apart opposed relation at the leaf second ends (8A)(8B). A post (11) comprising a post tubular member (11D) having a post length (12) disposed between a post first end (13) and post second end (14) and a post threaded internal surface (69) can pass through the first and second leaf member apertures (15)(16) correspondingly disposed in the first and second resilient leaf members (5)(6) proximate the first and second blades (9)(10). A pivot bearing element (63A) in the form of an elongate slot (71) can be axial disposed in the post first end portion (17). A leaf depressing lever (61) can have a lever first end (62) including leaf depressing lever pivot (63B). The leaf depressing lever pivot (63B) can be pivotally disposed in the elongate slot (71). The leaf depressing lever (61) can rotate about a pivot axis (63B') of the leaf depressing lever pivot (63B) to engage the first resilient leaf member (5) to move the first blade (9) by depressing the first resilient leaf member (5).

In the illustrative embodiment shown in FIGS. 28 and 29, a blade gap calibration adjustment assembly (35) can include a blade gap calibration member (36) and an outwardly extending calibration member threaded member (81). The blade gap calibration member (36) can radially outwardly extend to define a grippable calibration member edge (80). In particular embodiments, a blade gap index (54) including a plurality of indices (60) can be disposed on the grippable calibration member edge (80) which can be aligned by rotation of the blade gap calibration member (36) in relation to the blade gap index indicator (59), or a particular feature of the first or second leaf members (5)(6) or first or second blades (9)(10). While the plurality of indices (60) are shown on the grippable calibration member edge (80); this is not intended to preclude embodiments in which the plurality of indices (60) occur on top of the blade gap calibration member (35). The calibration member threaded member (81) can rotatably engage the post threaded internal surface (69) (the post (11) having a post unthreaded external surface (70)) to engage the leaf depressing lever pivot (63B). Rotation of the calibration member threaded member (81) in relation to the post threaded internal surface (69) correspondingly moves the leaf depressing lever pivot (63B) between opposite slot ends (71A)(71B) in the elongate slot (71). The leaf depressing lever pivot (63B) corresponding engages the first resilient leaf member (5) to correspondingly increase or decrease the calibrated distance (37) between the first and second blades (5)(6) to calibrate the blade gap (20). In the illustrative example of FIGS. 28 and 29, the embodiment lacks a blade gap adjustment assembly (19), but rather a post retainer (92) can be secured to the post second end (14) to spatially fix the post second (14) in relation to the second resilient leaf member (6). As shown in the example of FIG. 16, a calibration blade (50) can, but need not necessarily, be inserted between the first and second blades (9)(10) and the blade gap calibration member (36) rotated to engage the first and second blades (9)(10) with the calibration blade (50) having a known thickness, and the calibration blade (50) can be withdrawn to establish a calibrated distance (37) between the first and second blades (9)(10) to calibrate the blade gap (20) to the blade gap index (54).

Figure 30:
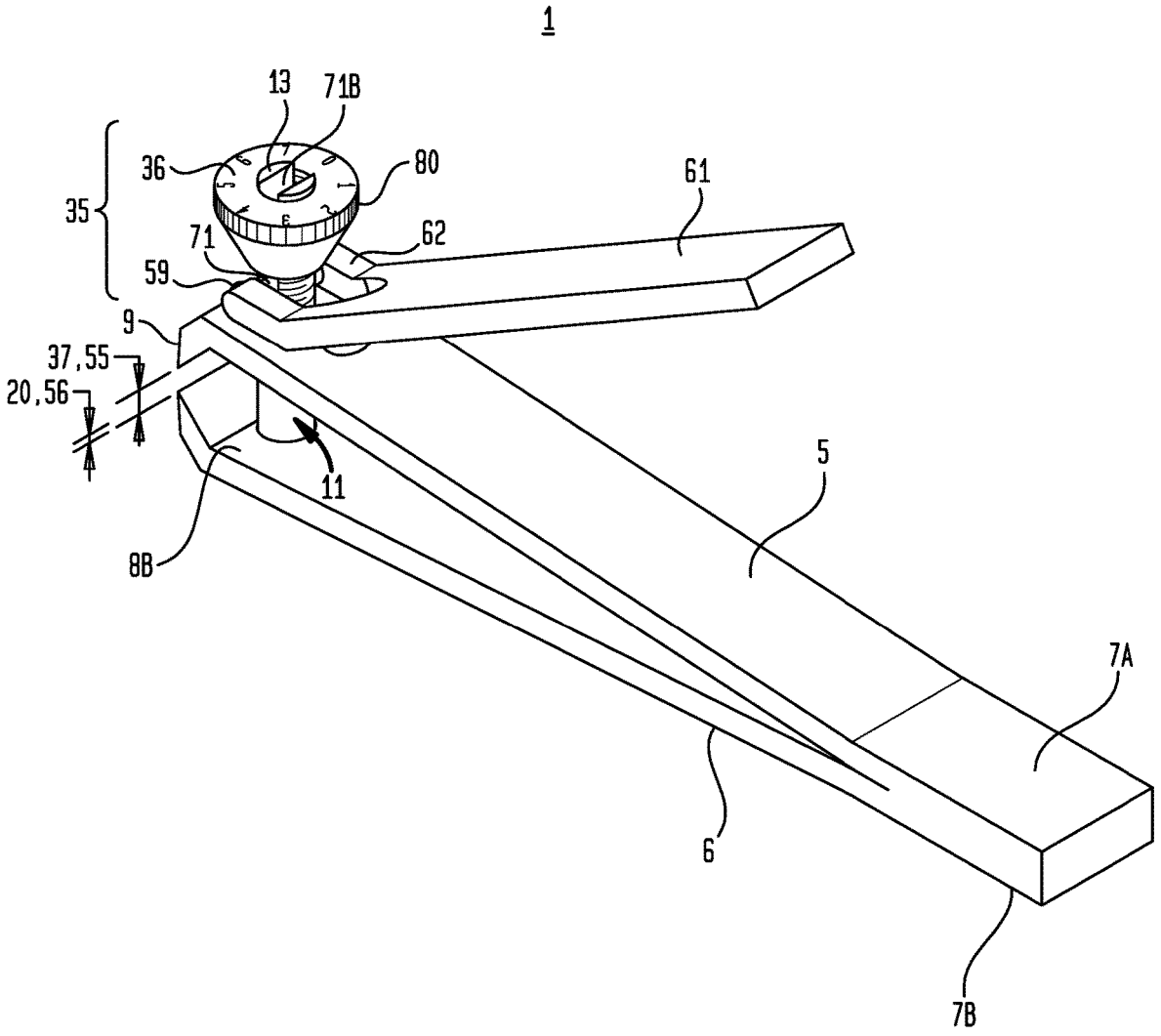
FIG. 30 is a perspective view of an embodiment of the adjustable blade gap clipper including a blade gap calibration assembly.
Figure 31:
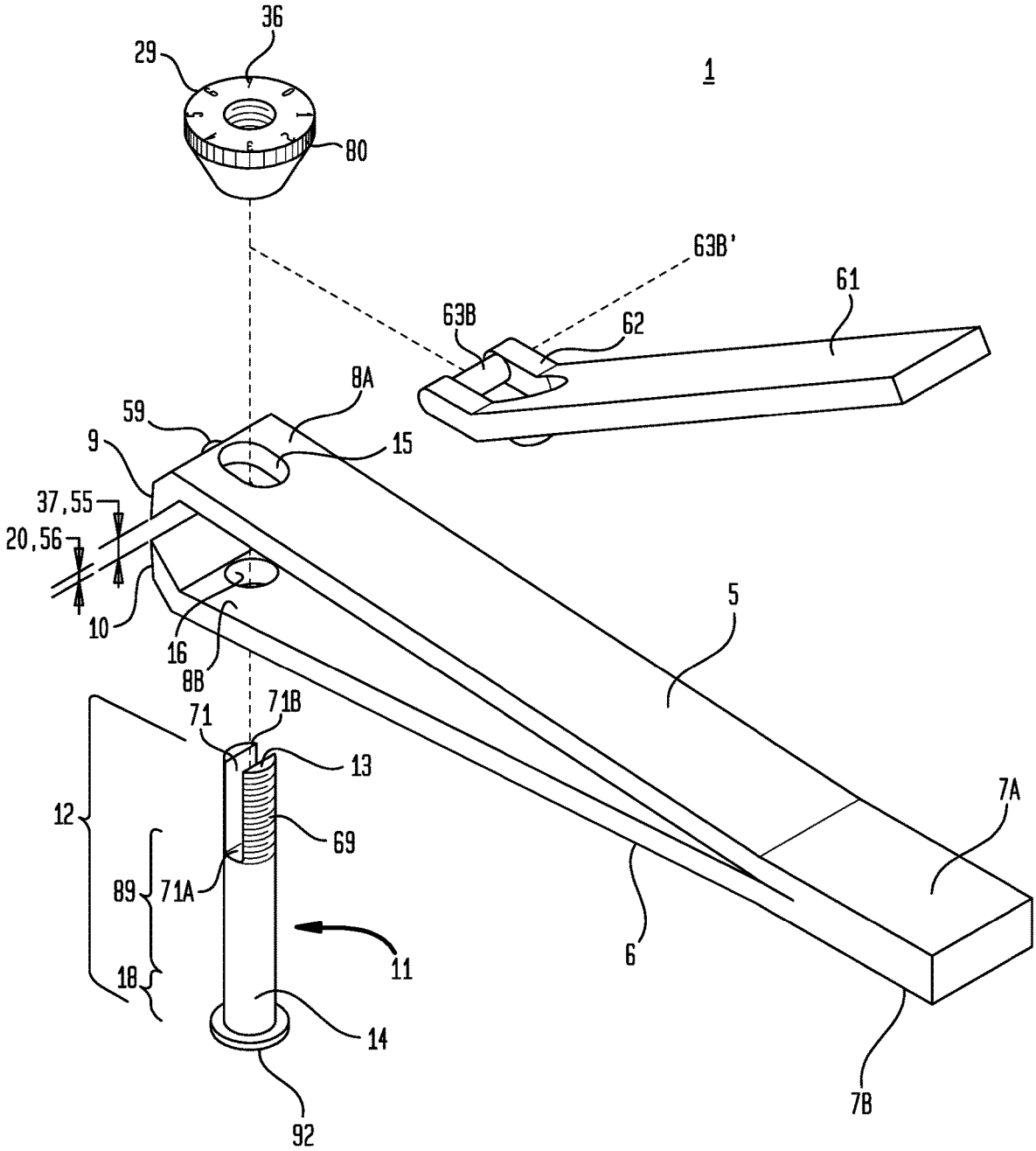
FIG. 31 is an exploded view of the embodiment of the adjustable blade gap clipper shown in FIG. 30.

Now, with primary reference to FIGS. 30 and 31, particular embodiments can include one or more of the elements above described and shown in FIGS. 26 and 27. The post (11) can include a post length (12) disposed between a post first end (13) and post second end (14). The post (11) can afford a post threaded external surface (69) proximate the post first end portion (17) and a post medial portion (89) and a post second end portion (18) affording a post unthreaded external surface (70). The post (11) can pass through the first and second leaf member apertures (15)(16) correspondingly disposed in the first and second leaf members (5)(6) proximate the first and second blades (9)(10) to allow the first leaf resilient member (5) to travel in relation to the post unthreaded external surface (70) and to dispose the post threaded external surface (67) of the first post end portion (17) to outwardly extend from the first leaf resilient member (5). In the particular embodiment shown in the example of FIGS. 30 and 31, an elongate slot (71) can be axial disposed in the post first end portion (17). The elongate slot (71) can have a slot first end (71A) opposite a slot second end (71B) open at the post first end (13). The leaf depressing lever pivot (63B) can be disposed in the elongate slot (71). The calibration adjustment assembly (19) as above described and shown in the illustrative example of FIG. 16 can close the slot second end (71B) by rotatable engagement of the blade gap calibration member (36) with the post threaded external surface (67) at the post first end (13) to provide a pivot bearing element (63A). Rotation of the blade gap calibration member (36) in relation to the post threaded external surface (67) correspondingly moves the leaf depressing lever pivot (63B) between opposite slot ends (71A)(71B) in the elongate slot (71) and correspondingly increases or decreases the calibration distance (37) between the first and second blades (5)(6) to calibrate the blade gap (20) to the blade gap index (54). A blade gap adjustment assembly (19) can, but need not necessarily, be coupled to the post second end (14). In the particular embodiments shown in FIGS. 30 and 31, a post retainer (92) can be secured to the post second end (14) to spatially fix the post second (14) in relation to the second resilient leaf member (6). In particular embodiments, a calibration blade (50) can be inserted between the first and second blades (9)(10) and the blade gap calibration member (36) rotated to engage the first and second blades (9)(10) with the calibration blade (60) having a known thickness, and the calibration blade (60) can be withdrawn to establish the calibrated distance (37) between the first and second blades (9)(10) to establish the blade gap (20).

As can be easily understood from the foregoing, the basic concepts of the present invention may be embodied in a variety of ways. The invention involves numerous and varied embodiments of an adjustable aperture clipper (1) and methods for making and using such adjustable aperture clipper (1) including the best mode. Additional embodiments of the adjustable blade gap clipper (1) can be assembled using components from the various embodiments above described and shown in the Figures. Particular embodiments may include and the blade gap (20) may be adjusted by operation of only the blade gap adjustment assembly (19) or only the blade gap calibration adjustment assembly (35), each of which may perform a similar function in the absence of the other. Other particular embodiments may include both of the blade gap calibration adjustment assembly (35) and the blade gap adjustment assembly (19), each having a separate structure and function in which the blade gap calibration adjustment assembly (35) operates to provide a blade gap (20) calibrated to a blade gap index (54) and the blade gap adjustment assembly (19) operates to incrementally adjust the blade gap (20) through the blade gap range (53) associated with blade gap index (54). The first leaf member and second leaf member (5)(6) are described and are shown as being similar or dissimilar between embodiments; it is to be understood that term "leaf members (5)(6)" is generic to all design configurations which can dispose the first and second blades (9)(10) in opposite relation and can be used with any of the embodiments of the blade gap calibration adjustment assembly (35) or any of the blade gap adjustment assembly (19), or a combinations thereof.

As such, the particular embodiments or elements of the invention disclosed by the description or shown in the figures or tables accompanying this application are not intended to be limiting, but rather illustrative of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "clipper" should be understood to encompass disclosure of the act of "clipping"—whether explicitly discussed or not—and, conversely, were there effectively disclosure of the act of "clipping", such a disclosure should be understood to encompass disclosure of a "clipper" and even a "means for clipping." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in Merriam-Webster's Collegiate Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the clippers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

What is claimed is:

1. A method, comprising:

coupling a first leaf member and a second leaf member at first leaf ends, said first and second leaf members diverging outwardly from said leaf first ends approaching said leaf second ends, said first and second leaf members correspondingly including a first blade and a second blade disposed in spaced apart opposed relation at said leaf second ends, said first blade or second blades moveable by depressing said first or second leaf members;

passing a post having a length disposed between a post first end and post second end through first and second leaf member apertures correspondingly disposed in said first and second leaf members proximate said first and second blades;

rotatably coupling a leaf depressing lever to said post first end, said leaf depressing lever rotates to engage said first leaf member to correspondingly move said first blade toward said second blade; and coupling a blade gap adjustor to said post second end, said blade gap adjustor including a first annular member joined in fixed spatial relation to a spacer, said first annular member joined to said spacer having a passage through which said post second end passes to engage said spacer with said second leaf member, said spacer disposes said first annular member a fixed distance from said second leaf member, said first annular member outwardly extending from said spacer to an outer annular wall, said second annular member having an inner annular wall which slidably engages in adjacent spatial relation to said outer annular wall of said first annular member, said second annular member moveable in relation to said post second end to urge said spacer against said second leaf member to adjust a blade gap between said first blade and second blade.

2. The method of claim 1, further comprising disposing a pivot bearing on said post first end, said leaf depressing lever first end rotates in said pivot bearing to engage said leaf depressing lever with said first leaf member, said blade gap adjustor moveable in relation to said post second end to engage said second leaf member to adjust said blade gap between said first blade and said second blade.

3. The method of claim 1, wherein said blade gap adjustor and said post second end threadingly engage, said blade gap adjustor rotated in relation to said post second end to move said blade gap adjustor in relation to said post second end to engage said second leaf member to correspondingly move said second blade to adjust said blade gap between said first blade and said second blade.

4. The method of claim 1, further comprising coupling a blade gap calibrator movable in relation to said post second end moves said second leaf member to calibrate said blade gap to a blade gap index, whereby subsequent movement of said blade gap adjustor on said post second end adjusts distance between said first and second blades occurring within a range between blade gap index first and second end points.

5. The method of claim 1, rotatably engaging a blade gap calibrator to said blade gap adjustor, said blade gap calibrator rotates in relation to said post second end to move said blade gap adjustor to engage said first or second leaf member to adjust said blade gap; and subsequently fastening said blade gap calibrator in fixed spatial relation to said blade gap adjustor allowing subsequent movement of said blade gap adjustor in relation to said post second end to adjust distance between said first and second blades occurring within a range between blade gap index first and second end points.

6. The method of claim 5, wherein said blade gap set by rotation of said blade gap calibrator calibrates incremental increase or decrease of said blade gap to a standard scale of said blade gap indices disposed between said blade gap index first and second end points disposed on said blade gap adjustor.

7. A method of using an apparatus, said apparatus including:

a first leaf member and second leaf member each including a leaf first end opposite a leaf second end, said first and second leaf members coupled at said leaf first ends and diverging outwardly approaching said leaf second ends, said first and second leaf members correspondingly including a first blade and a second blade disposed in spaced apart opposed relation at said leaf second ends, said first or second blades moveable by depressing said first or second leaf member;

a post having a length disposed between a post first end and a post second end, said post passing through first and second leaf member apertures correspondingly disposed in said first and second leaf members proximate said first and second blades;

a leaf depressing lever rotatably coupled to said post first end, said leaf depressing lever rotates to engage said first leaf member to correspondingly move said first blade toward said second blade; and a blade gap adjustor coupled to said post second end, said blade gap adjustor including a first annular member joined in fixed spatial relation to a spacer, said first annular member joined to said spacer having a passage through which said post second end passes to engage said spacer with said second leaf member, said spacer disposes said first annular member a fixed distance from said second leaf member, said first annular member outwardly extending from said spacer to an outer annular wall, said second annular member having an inner annular wall which slidably engages in adjacent spatial relation to said outer annular wall of said first annular member, said second annular member moveable in relation to said post second end to urge said spacer against said second leaf member to adjust a blade gap between said first blade and second blade, said method comprising:

moving said blade gap adjustor in relation to said post second end to engage said second leaf member to adjust a blade gap between said first blade and second blade.

8. The method of claim 7, further comprising:

rotating said lever first end in a pivot bearing disposed in said post first end to engage said leaf depressing lever with said first leaf member; and moving said blade gap adjustor in relation to said post second end to engage said second leaf member to adjust said blade gap between said first blade and said second blade.

9. The method of claim 7, wherein said apparatus further includes a blade gap calibrator movable in relation to said post second end to correspondingly move said second leaf member to calibrate said blade gap to a blade gap index disposed on said blade gap adjustor, said method further comprising:

subsequently moving said blade gap adjustor to correspondingly move said second leaf member to a calibrated distance between said first and second blades occurring within a range between blade gap index first and second end points.

10. The method of claim 9, wherein said blade gap calibrator rotatably engages said blade gap adjustor, said blade gap calibrator rotates in relation to said post second end to move said blade gap adjustor to engage said first or second leaf members to adjust said blade gap, said method further comprising:

subsequently fastening said blade gap calibration element in fixed spatial relation to said blade gap adjustor; and subsequently moving said blade gap adjustor in relation to said post second end to adjust distance between said first and second blades occurring within a range between blade gap index first and second end points.

* * * * *